US007701426B2

(12) United States Patent
Yokoyama et al.

(10) Patent No.: US 7,701,426 B2
(45) Date of Patent: Apr. 20, 2010

(54) DISPLAY DEVICE AND METHOD OF DRIVING THE SAME

(75) Inventors: Makoto Yokoyama, Matsusaka (JP); Hajime Washio, Sakurai (JP); Yuhichiroh Murakami, Matsusaka (JP); Etsuo Yamamoto, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1086 days.

(21) Appl. No.: 10/941,082

(22) Filed: Sep. 15, 2004

(65) Prior Publication Data

US 2005/0088387 A1 Apr. 28, 2005

(30) Foreign Application Priority Data

Sep. 17, 2003 (JP) ..... 2003-325187
Aug. 23, 2004 (JP) ..... 2004-242985

(51) Int. Cl.
*G09G 3/36* (2006.01)

(52) U.S. Cl. ..... 345/87; 345/103

(58) Field of Classification Search ..... 345/87–103, 345/204, 210
See application file for complete search history.

(56) References Cited

U.S. PATENT DOCUMENTS

| | | | | |
|---|---|---|---|---|
| 4,990,905 | A * | 2/1991 | Kuijk | 345/210 |
| 5,892,493 | A * | 4/1999 | Enami et al. | 345/94 |
| 6,661,401 | B1 * | 12/2003 | Sekine | 345/92 |
| 2001/0020929 | A1 | 9/2001 | Nagata et al. | |
| 2002/0196240 | A1 * | 12/2002 | Hajime et al. | 345/204 |
| 2003/0006955 | A1 * | 1/2003 | Tsuchi | 345/92 |
| 2003/0030616 | A1 * | 2/2003 | Maeda et al. | 345/98 |
| 2003/0117362 | A1 | 6/2003 | An | |
| 2003/0132903 | A1 * | 7/2003 | Ueda | 345/87 |
| 2004/0017341 | A1 | 1/2004 | Maki | |
| 2005/0041488 | A1 | 2/2005 | Ito et al. | |

FOREIGN PATENT DOCUMENTS

| | | |
|---|---|---|
| EP | 0 755 044 | 1/1997 |
| JP | 9-33891 A | 2/1997 |

(Continued)

OTHER PUBLICATIONS

TW 522373, Mar. 1, 2003 corresponds to US 2003/0006955 listed above.

(Continued)

*Primary Examiner*—Amare Mengistu
*Assistant Examiner*—Jennifer Zubajlo
(74) *Attorney, Agent, or Firm*—Nixon & Vanderhye P.C.

(57) ABSTRACT

In each horizontal period, by switching ON switches respectively provided for three data signal lines for R, G and B in a group at the same time only in a predetermined period, the data signal lines in the group are preliminary charged to a predetermined potential at the same time before a data signal supply period. In a subsequent data signal supply period, respective switches of data signal lines for R, G and B are switched ON sequentially, to sequentially supply respective data for R, G and B to pixels on a scanning signal line as selected are supplied via data signal lines. As a result, in a display device driven by time-division based on a group of sequentially provided data signal lines, it is possible to suppress up-throw potential fluctuations when display.

19 Claims, 15 Drawing Sheets

FOREIGN PATENT DOCUMENTS

| | | | |
|---|---|---|---|
| JP | 10-39278 | | 2/1998 |
| JP | 10-105126 | A | 4/1998 |
| JP | 10-143118 | A | 5/1998 |
| JP | 11-271714 | | 10/1999 |
| JP | 11-338438 | | 12/1999 |
| JP | 2001-142045 | | 5/2001 |
| JP | 2003-058118 | | 2/2003 |
| JP | 2003-122313 | A | 4/2003 |
| JP | 2004/12944 | A | 1/2004 |
| JP | 2005-43418 | A | 2/2005 |
| TW | 518527 | | 1/2003 |

OTHER PUBLICATIONS

Taiwanese Office Action issued Dec. 21, 2007 with English translation.

* cited by examiner

DISPLAY DEVICE AND METHOD OF DRIVING THE SAME

This non-provisional application claims priority under 35 U.S.C. §119(a) on Patent Application No. 2003/325187 filed in Japan on Sep. 17, 2003, and Patent Application No. 2004/242985 filed in Japan on Aug. 23, 2004, the entire contents of which are hereby incorporated by reference.

FIELD OF THE INVENTION

The present invention relates to a display device which displays by supplying externally supplied data to a display section via data signal lines by time division.

BACKGROUND OF THE INVENTION

Known methods of driving a display device provided with a pixel section in which a plurality of pixels are arranged two-dimensionally in a matrix form at respective intersections between a plurality of scanning signal lines and a plurality of data signal lines include the SSD (Source Shared Driving) method. In this driving method, a plurality of data signal lines in a group are driven by a common data output circuit. For example, data signal lines for R, G and B are provided respectively, and the data signal lines for R, G and B which form a set of colors in each group are driven by a data output circuit in a data signal line driving circuit provided in each group in common among R, G and B. By this data output circuit, data is output to data signal lines for R, G and B in this order for each group. Here, in order to ensure the time for writing data signals from each data signal line to a pixel while increasing the driving speed, the data signal lines in the same color of respective groups are driven at the same time. According to the foregoing driving method, to meet a demand for higher resolution of a display device in which a large number of data signal lines are closely packed together, it is possible to reduce a size of the data signal line driving circuit without reducing the driving speed.

FIG. 9 illustrates an example structure of a display panel 1 of the liquid crystal display device adopting the SSD method. This display panel 1 is driven by a scanning signal line driving circuit (not shown) and a data signal line driving circuit 17, and includes a plurality of scanning signal lines GL and a plurality of data signal lines (source bus lines) RSL, GSL and BSL arranged in a matrix form. In FIG. 9, the scanning signal lines GL are designated as GL1, GL2 and GLn in this order from the side of the data signal line driving circuit 17 (from the top of the sheet of FIG. 9). A plurality of data signal lines are divided into groups of data signal lines RSL, GSL and BSL, some of the groups of the data signal lines are shown in FIG. 9 and indicated from the left end, as data signal lines RSLn−1, GSLn−1 and BSLn−1 in the n−1th group, data signal lines RSLn, GSLn and BSLn in the nth group, and data signal lines RSLn+1, GSLn+1 and BSLn+1 in the n+1th group.

Pixels PIX are provided at respective intersections between the scanning signal lines GL and the data signal lines RSL, GSL and BSL two-dimensionally to form a pixel section 11. Each pixel PIX includes a TFT 12, a liquid crystal capacitance 13 and an auxiliary capacitance 14, and the liquid crystal capacitance 13 and the auxiliary capacitance 14 are connected to the data signal line RSL, GSL or BSL via the TFT 12. The gate of each TFT 12 is connected to the scanning signal line GL. Incidentally, the electrode on the side of the TFT 12 of the liquid crystal capacitance 13 serves as a common electrode. Furthermore, the electrode of the auxiliary capacitance 14 facing the electrode of the TFT 12 is connected to an auxiliary capacitance line CsL.

The respective ends of the data signal lines RSL, GSL, BSL on the side of the data signal line driving circuit 17 (on the upstream side in the direction of supplying data signal) are connected to analog switches ASW. As shown in FIG. 9, analog switches ASWRn−1 , ASWGn−1 and ASWBn−1 are provided corresponding to RSLn−1, GSLn−1 and BSLn−1, analog switches ASWRn, ASWGn and ASWBn are provided corresponding to data signal lines RSLn, GSLn and BSLn, and analog switches ASWBn+1 are provided corresponding to data signal lines RSLn+1, GSLn+1 and BSLn+1.

The analog switch ASWR connected to the data signal line RSL for R is switched ON/OFF by a switching signal Ron, the analog switch ASWG connected to the data signal line GSL for G is switched ON/OFF by a switching signal Gon, and the analog switch ASWB connected to the data signal line BSL for B is switched ON/OFF by a switching signal Bon. A control circuit 18 is provided for outputting these switching signals Ron, Gon and Bon.

Here, respective terminals of the analog switches ASWR, ASWG and ASWB in the same group of data signal lines on the opposite side of the data signal lines (on the upstream side in the direction of supplying a data signal) are mutually connected by a common wiring 15. In FIG. 9, the corresponding group numbers are given as subscripts to the common wirings 15. These common wirings 15 are connected to respective data output circuits DOAn−1, DOAn and DOAn+1 provided for each group in the data signal line driving circuit 17. Namely, each of these data output circuits DOAn−1, DOAn and DOAn+1 is used in common among all the data signal lines in the same group. In FIG. 9, the analog switches ASWRn−1, ASWGn−1 and WSBn−1 are connected to the data output circuit DoAn−1 which outputs data DATAn−1, the analog switches ASWRn, ASWGn and ASWBn are connected to the data output circuit DoAn which outputs data DATAn, and the analog switches ASWRn+1, ASWGn+1 and ASWBn+1 are connected to the data output circuit DOAn+1 which outputs data DATAn+1.

The respective analog switches ASW in the same group are switched ON/OFF so that the ON period transits in the order of R, G and B, for example, and the ON/OFF of the supply of the data from the common data output circuit DOA to the data signal lines changes among R, G and B. As described, a data switching section 16 made up of three data switches is provided for each group of data signal lines. In FIG. 9, the corresponding group number is given as a subscript to the data switching section 16.

Next, the method of driving the liquid crystal display device will be explained. Specifically, the supply of a data signal in a certain horizontal period, i.e., to a data signal line for one scanning period will be explained. FIG. 10 shows a timing chart. In the data switching sections 16 shown in FIG. 10, switching signals Ron, Gon and Bon are supplied by time-division, and in synchronous with the supply of these signals, the data DATAn is input as the DATAn(R), DATAn (D) and DATAn(B). In the certain horizontal period 1H, a scanning signal line GLi is selected, and the ON period of the switching signal transits in each group of data signal lines in the order of Ron→Gon→Bon, thereby outputting data to the data signal lines in the order of DATAn(R)→DATAn(D) →DATAn(B).

Here, adopted is the method of driving liquid crystal, called "1H inversion driving", wherein the data DATA is selected in each horizontal period, for example, from the positive-polarity potential range of 6 V to 10.5 V and the negative-polarity potential range of 1.5 V to 6 V. Generally, a liquid crystal material for use in the liquid crystal display device alternates a voltage to be applied to a liquid crystal material. In the conventional driving method, one of the potentials to be supplied to the liquid crystal material is set the potential of the data DATA, and the other potential is set around 6 V. In the certain horizontal period (1H), the data DATA having the positive-polarity potential (6 V to 10.5 V) is supplied, and in the subsequent horizontal period (1H), the DATA having the negative-polarity potential (1.5 V to 6 V) is supplied. In the next frame, the data DATA whose polarity is inversed is supplied, and the AC driving of the liquid crystal is performed. In FIG. 10, in a certain frame, the negative-polarity data DATA is supplied to the data signal line in the previous horizontal period, and in the subject horizontal period, the positive-polarity DATA is supplied.

FIG. 11 illustrates an example structure of a display panel 2 of another liquid crystal display device in which driving is performed by the SSD method. The members having the same reference numerals as those of the liquid crystal panel 1 shown in FIG. 9 are designated as the same reference numerals. In FIG. 11, the adjoining odd-numbered data signal line OSL and the even-numbered data signal line ESL form a pair. The terminal of the data signal line OSL on the side of the data signal line driving circuit 27 (upstream side in the direction of supplying data signal) is connected to the analog switch ASWO, and the terminal of the data signal line ESL on the side of the data signal line driving circuit 27 (on the upstream side in the direction of supplying data) is connected to the analog switch ASWE. The analog switch ASWO is switched ON/OFF by the switching signal ODDon, and the analog switch ASWE is switched ON/OFF by the switching signal EVENon.

Here, respective terminals of the analog switches ASWO and ASWE in the same group of data signal lines on the opposite side of the data signal lines (on the upstream side in the direction of supplying data signal) are connected via the common wiring 25. This common wiring 25 is connected to the data output circuit DOB provided in the data signal line driving circuit 27 for each group. Namely, each data output circuit DOB is used in common among all the data signal lines in the same group. This data output circuit DOB outputs the data DATA. The analog switches ASW in the same group are switched ON/OFF so that the ON period transits in the order of ASWO to ASWE, for example, and whether the data is supplied or not supplied from the common data output circuit to the data signal line is switched between the odd-numbered data signal line and the even-numbered data signal line. As described, a data switching section 26 made up of two data switches is provided for each group of data signal lines.

FIG. 12 shows a timing chart of driving the liquid device adopting the 1H inversion driving. In the data switching sections 26 shown in FIG. 12, switching signals ODDon, EVENon are supplied by time-division from the control circuit 28. In synchronous with the supply of these switching signals ODDon and EVENon, the data DATAn in the nth group is input as DATAn (ODD) and DATAn(EVEN). In the certain horizontal period 1H, the gate signal line GLi is selected, and in this period, the ON period of the switching signal in each group of the data signal lines transits in the order of ODDon to EVENon, and the data is output to the data signal line in the order of DATAn(ODD) to DATAn(EVEN).

The following documents are listed for the relevant prior art documents.

(Document 1)

Japanese Unexamined Patent Publication No. 11-338438/1999 (Tokukaihei 11-338438), published on Dec. 10, 1999.

(Document 2)

Japanese Unexamined Patent Publication No. 10-39278/1998 (Tokukaihei 10-39278), published on Feb. 13, 1998.

(Document 3)

U.S. Patent Application Publication No. US 2001/0020929 A1).

The timing chart of FIG. 10 will be explained in more details. When the switching signals Ron, Gon and Bon are sent by time-division, and the data DATAn(R), DATAn(D) and DATAn(B) are supplied to the data signal lines RSLn, GSLn and BSLn, first, the data DATAn(R) is supplied to the data signal line RSLn by the switching signal Ron, and the data signal line RSLn is stably charged to the potential of the data DATAn(R). By the switching signals Gon and Bon, the analog switches ASWGn and ASWBn are set in the OFF state, and the data signal lines GSLn and BSLn are set in the floating state, and the data signal lines RSLn, GSLn and BSLn are subjected to capacitive coupling. Therefore, for example, with a sudden increase in potential of the data signal line RSLn, the respective potentials of the adjacent data signal line BSLn−1 and GSLn in the floating state, and the potential of the data signal line BSLn are subjected to fluctuations. In FIG. 10, the foregoing potential fluctuations are not shown.

Next, the switching signal Ron is not supplied, and the switching signal Gon is supplied to supply the data DATAn (G) to the data signal line GSLn. This data signal line GSLn is stably charged to the potential of the data DATAn(G); however, the analog switch ASWRn is switched in the OFF state by the switching signal Ron, and the data signal line RSLn is set in the floating state. Therefore, the potential of the data signal line RSLn changes by $\Delta V1$, and this change in potential is referred to as up-throw potential fluctuations $\Delta V1$. The respective potentials of the adjacent data signal line BSLn−1 and BSLn are also subjected to fluctuations at the same time. The foregoing potential fluctuations are not shown in FIG. 10.

Next, the switching signal Gon is not supplied, and the switching signal Bon is supplied to supply the data DATAn (B) to the data signal line BSLn. The data signal line BSLn is stably charged to the potential of the data DATAn(B). By the switching signals Ron and Gon, the analog switches ASWRn and ASWRn are set in the OFF state, and the data signal lines RSLn and GSLn are set in the floating state, and the data signal lines RSLn, GSLn and BSLn are subjected to capacitive coupling. Therefore, the data signal line RSLn is subjected to further up-throw potential fluctuations from the state where the data DATAn(R) is supplied to the data signal line RSLn from $\Delta V1$ to $\Delta V2$, due to the potentials of the data signal line BSLn−1 and the potential of the data signal line GSLn. Similarly, the potential of the data signal line GSLn is subjected to the up-throw potential fluctuations by $\Delta V3$ due to the potentials of the data signal line RSLn−1 and the potential of the data signal line BSLn from the state where the data DATAn(G) is supplied to the data signal line GSLn.

As described, when data are sequentially supplied to the data signal lines by time division, only the most currently charged data DATAn(B) is charged without being affected by up-throw potential fluctuations due to capacitive coupling, and upon completing the function of the scanning signal for controlling the charge of the pixel in one horizontal period, the color in the potential of the pixel as charged is displayed in the display section. Here, as explained above, the up-throw potential fluctuations $\Delta V$ due to the capacitive coupling are accumulated corresponding to respective data signal lines by the order of the supply period of the switching signal Ron→Gon→Bon. Therefore, for example, when an attempt is made to display in an intermediate tone (gray), by setting the data DATAn(R), DATAn(G) and DATAn(B) to the same potential, the respective potentials of VRSLn, VGSLn and VBSLn of the final data signal lines RSLn, GSLn and BSLn hold the relationship of VRSLn>VGSLn>VBSLn. Here, in the case where the liquid crystal display is in a normally while mode, it is displayed in dark bluish gray. In response to the foregoing problem, the prior art document 1 adopts the means of altering the order of switching the switches in recognizing the importance in the wavelength dependency of a liquid crystal material.

In the driving method shown in the timing chart of FIG. 12, when the data signal is supplied to the data signal line ESLn, the data signal line OSLn after having the data DATAn (ODD) supplied are subjected to up-throw potential fluctuations by ΔV11.

As described, the conventional driving methods wherein the potential of the data signal line is changed significantly in the positive direction and the negative direction at each horizontal period by the 1H inversion driving present the problem in that up-throw potential fluctuations ΔV become large, resulting in poor display quality due to changes in color.

Furthermore, when supplying negative-polarity data to the data signal lines RSLn, GSLn and BSLn, down-throw potential fluctuations occur in a direction opposite to the positive-polarity.

The foregoing up-throw potential fluctuations ΔV are noticeable in a display device wherein a large number of data signal lines are closely packed together, and electrostatic capacitive coupling between the data signal lines is strong, such as a liquid crystal display device adopting the SSD method.

SUMMARY OF THE INVENTION

It is an object of the present invention to provide a display device and a method of driving the same wherein the display device is driven by time-division based on a group of sequentially provided data signal lines, which permit up-throw potential fluctuations and down-throw potential fluctuations when display to be suppressed.

In order to achieve the foregoing object, the display device of the present invention is arranged so as to include:

a plurality of data signal lines divided into a plurality of groups, each group being made up of sequentially provided data signal lines;

a plurality of scanning signal lines;

a plurality of pixels, provided respectively at intersections of the plurality of data signal lines and the plurality of scanning signal lines;

a plurality of switches provided for each group of data signal lines, wherein respective data output sides of the plurality of switches are connected to respective ends on one side of the plurality of data signal lines, and respective data input sides of the plurality of switches are mutually connected; and a charging circuit (DOA, DOB) for charging the data signal lines in each group of data signal lines to a predetermined potential in a period other than a data signal supply period of the group.

According to the foregoing structure, by switching each switch to a data signal line in the group, it is possible to charge all the data signal lines in the group to a predetermined potential before a data signal supply period for supplying a data signal by time-division. In this structure, by setting the predetermined potential to a potential approximate to the potential to be applied to the data signal line in the data signal supply period, fluctuations of the potential to be applied to each data signal line due to the supply of a data signal in the data signal supply period can be made smaller as compared to the potential fluctuations from the potential of the data signal lines directly before supplying a data signal in the case where the data signal lines are not charged in advance to the predetermined potential.

In order to achieve the foregoing object, another display device in accordance with the present invention is arranged such that:

a plurality of data signal lines divided into a plurality of groups, each group being made up of sequentially provided data signal lines;

a plurality of scanning signal lines;

a plurality of pixels, provided respectively at intersections of the plurality of data signal lines and the plurality of scanning signal lines;

a plurality of switches provided for each group of data signal lines, wherein respective data output sides of the plurality of switches are connected to respective ends on one side of the plurality of data signal lines, and respective data input sides of the plurality of switches are mutually connected;

a potential line to which a predetermined potential is to be applied; and an auxiliary switch for connecting each data signal line to the potential line.

As described, the data signal line is connected to the potential line to which a predetermined potential is applied via the auxiliary switch which is different from the plurality of switches, by switching each switch to a data signal line in the group, it is possible to charge all the data signal lines in the group to a predetermined potential before a data signal supply period for supplying a data signal by time-division. In this structure, by setting the predetermined potential to a potential approximate to the potential to be applied to the data signal line in the data signal supply period, the potential fluctuations of each data signal line with a supply of a data signal in the data signal supply period can be made smaller as compared to the potential fluctuations of the potential of the data signal lines directly before supplying a data signal in the case where the data signal lines are not charged to the predetermined potential.

In order to achieve the foregoing object, another method of driving a display device, which includes a plurality of data signal lines divided into a plurality of groups, each group being made up of sequentially provided data signal lines, and a plurality of pixels, provided respectively at intersections of the plurality of data signal lines and a plurality of scanning signal lines, data signal lines in each group are driven by time-division via a common wiring provided on a data signal supply side, the method including:

a first step for outputting a data signal to data signal lines in each group in a data signal supply period of the group; and a second step for charging data signal lines in the group to a predetermined potential in a period other than a data signal supply period of the group.

According to the foregoing structure, the data signal lines in each group can be charged to the predetermined potential in a period other than the data signal supply period of the group. Therefore, it is possible to charge all the data signal lines of the group to a predetermined potential before a data signal supply period for supplying a data signal by time-division. By setting the predetermined potential to the potential close to the potential to be applied to the data signal line in the data signal supply period, potential fluctuations of each data signal line due to the supply of a data signal in the data signal supply period can be made smaller as compared to the potential fluctuations from the potential of the data signal lines directly before supplying a data signal in the case where the data signal lines are not charged to the predetermined potential.

With the foregoing method, it is therefore possible to avoid a problem associated with the supply of data signals to data signal lines in each group, i.e., the data signal lines having the data signals supplied are subjected to significant potential fluctuations due to the electrostatic coupling of the data signal lines. Furthermore, by charging the data signal lines in all the groups to the predetermined potential at the same time, it is possible to suppress the effects from the data signal lines in the adjacent group.

With the foregoing structure, it is possible to realize a display device and a method of driving the display device wherein data signal lines are driven by time-division based on a group of sequentially provided data signal lines, which permit up-throw potential fluctuations and down-throw potential fluctuations when display to be suppressed.

For a fuller understanding of the nature and advantages of the invention, reference should be made to the ensuing detailed description taken in conjunction with the accompanying drawings.

DESCRIPTION OF THE EMBODIMENTS

First Embodiment

Figure 7:
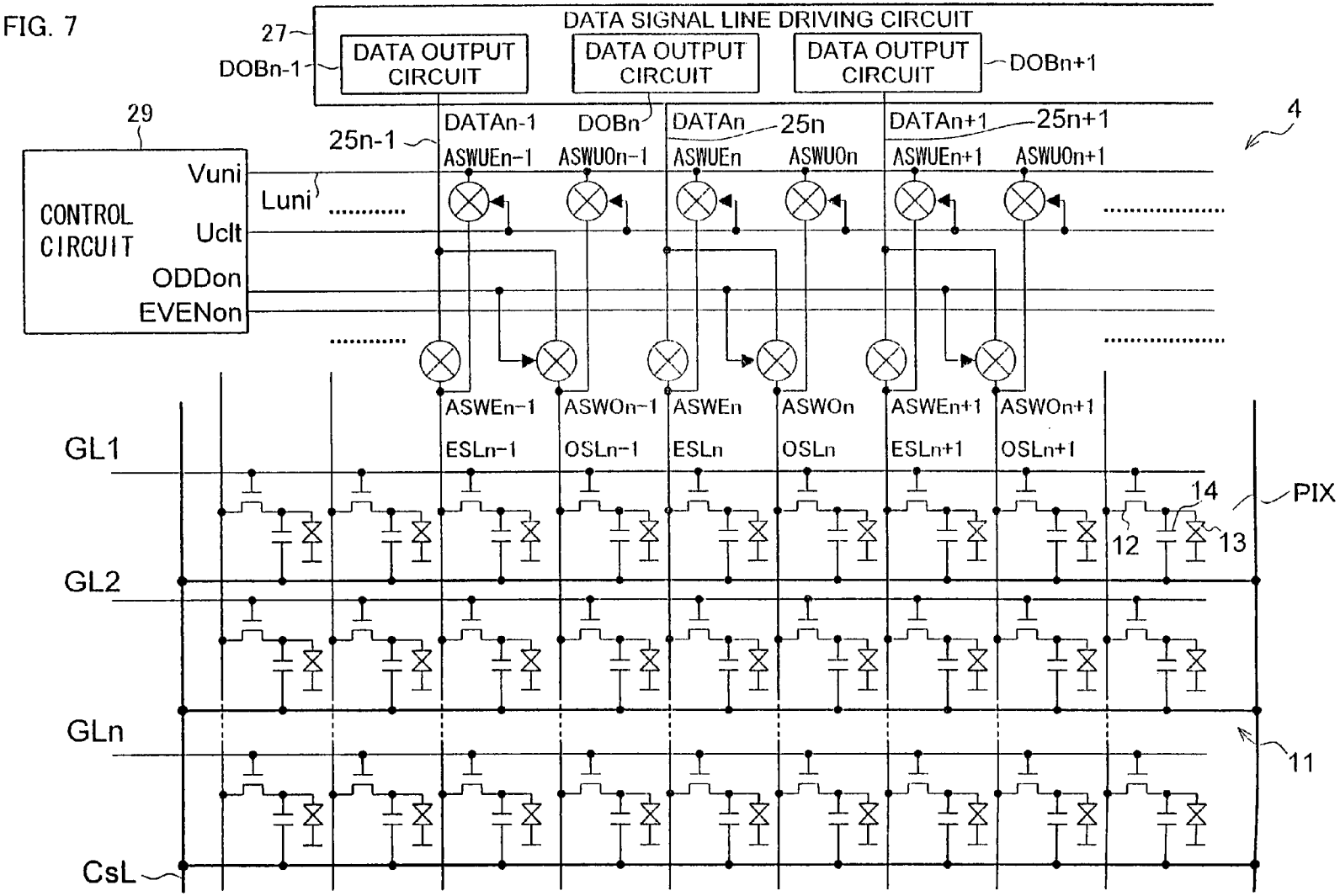
FIG. 7 is a block diagram of a circuit which shows the structure of a display panel in accordance with the fourth embodiment of the present invention.
Figure 8:
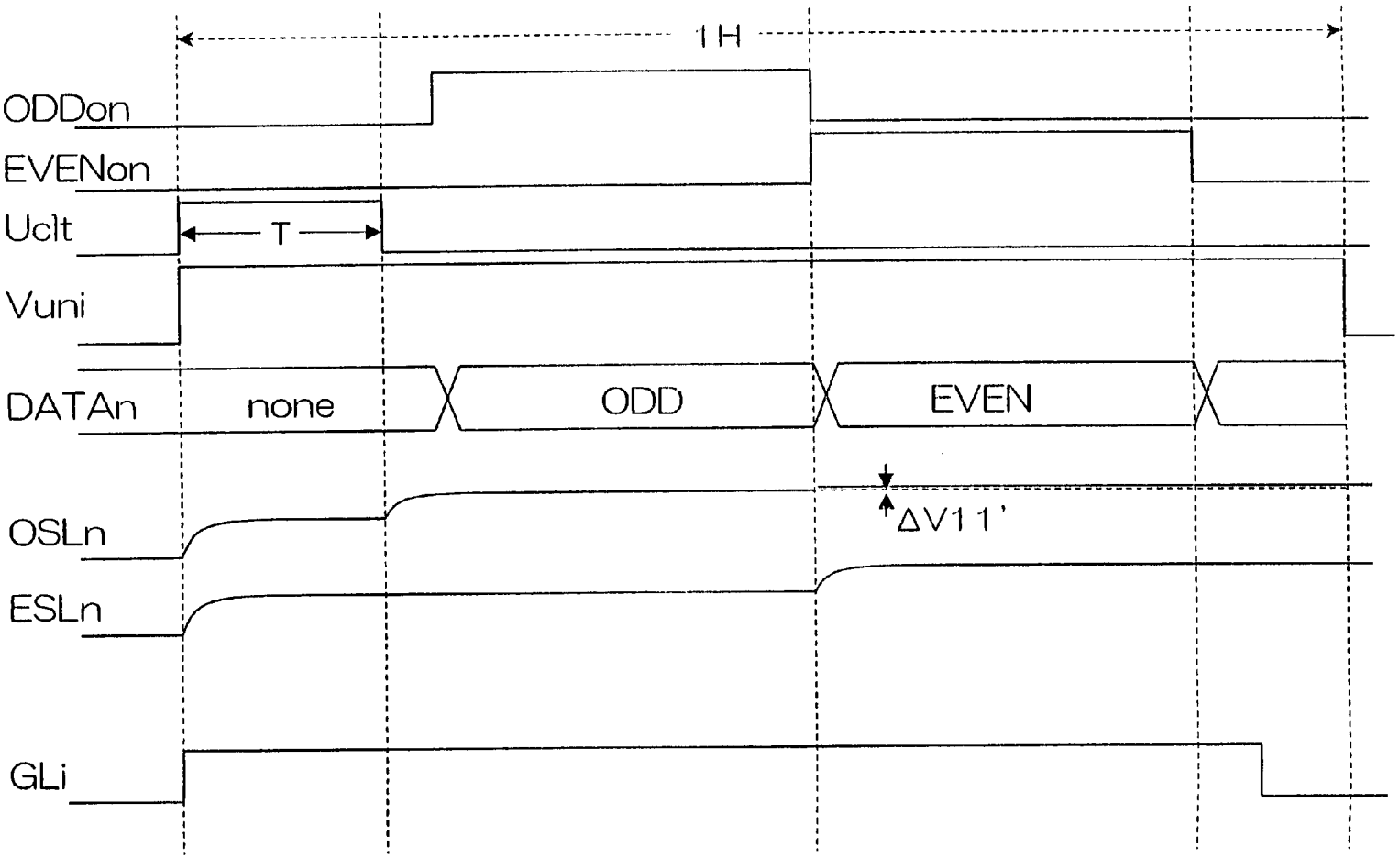
FIG. 8 is a timing chart which explains the driving method of the display panel in accordance with the fourth embodiment.
Figure 9:
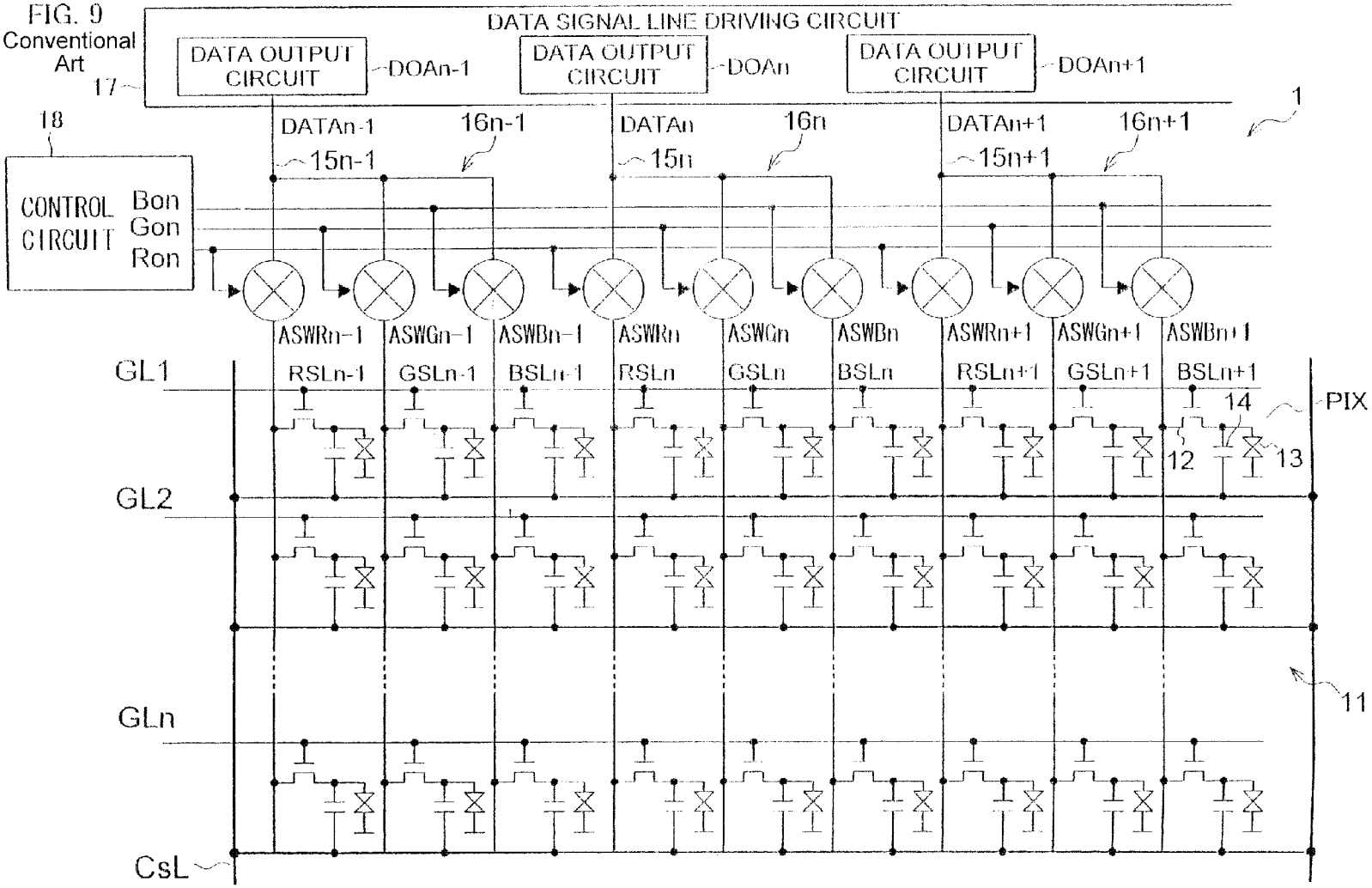
FIG. 9 Conventional Art
FIG. 9 is a block diagram of a circuit which shows the structure of a display panel of a liquid crystal display device adopting the SSD method.

The following will explain one embodiment of the present invention with reference to FIG. 1 through FIG. 9. FIG. 9 shows the structure of a display panel 1 provided in a liquid crystal display device adopting the SSD method. For ease of explanation, members (structures) having the same functions as those shown in the drawings pertaining to the earlier explained conventional structure will be given the same reference symbols, and explanations of the present embodiment will be given for those different from the conventional driving method.

Figure 1:
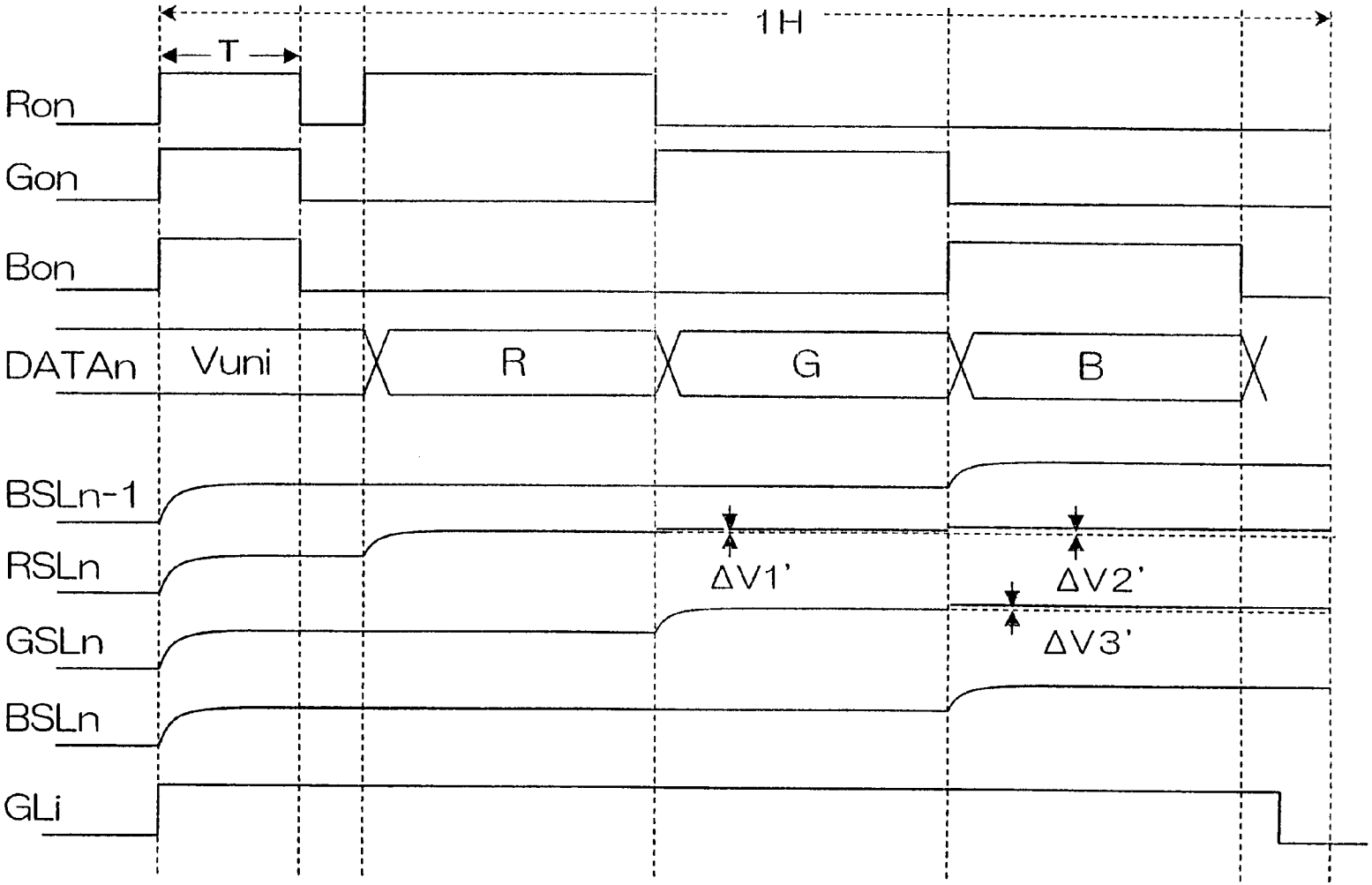
FIG. 1 is a timing chart which explains a driving method of a liquid crystal panel in accordance with the first embodiment of the present invention.

In the present embodiment, the display panel 1 is driven as shown in the timing chart of FIG. 1. Firstly, this timing chart of FIG. 1 will be explained. The timing chart of FIG. 1 also adopts the 1H inversion driving as in the case of the earlier explained conventional driving method. Specifically, in each horizontal period, switching signals Ron, Gon and Bon are supplied by time-division, so that the conduct period of analog switches ASWRn, ASWGn and ASWBn transits in this order, and the DATAn(R), DATAn(D) and DATAn(B) are sequentially supplied to data signal lines RSLn, GSLn and BSLn. In the present embodiment, in each horizontal period, before the data signal supply period in which the switching signals Ron, Gon and Bon are supplied to output these data signals, the switching signals Ron, Gon and Bon are supplied only in the predetermined period T at the same time, to conduct the analog switches ASWRn, ASWGn and ASWBn at the same time. The foregoing operation is performed simultaneously for respective groups of data signal lines.

Then, in this predetermined period T, a potential (predetermined potential) Vuni is applied to each data signal line via the common wiring 15 from the data output circuit DOA in each group. As illustrated in FIG. 9, in the predetermined period T, each data signal line is stably charged to a potential Vuni. In the following, this charging operation is called "preliminary charging". The foregoing preliminary charging of each data signal line is performed when a selection signal of the scanning signal line GLi is output. Therefore, the pixel as selected is charged so that the data signal line side is set to a predetermined potential Vuni.

For this potential (predetermined potential) Vuni, respective values corresponding to the positive-polarity and the negative-polarity in the 1H inversion driving are set. In the case where the positive-polarity potential is set in the range of 6 V to 10.5 V, and the negative-polarity potential is set in the range of 1.5 V to 6 V, the potential Vuni is set an average value of the maximum value and the minimum value in the positive-polarity potential range, i.e., 8.25 V and an average value of the maximum value and the minimum value in the negative-polarity potential range, i.e., 3.75 V. In FIG. 1, the horizontal period in which a data signal of the positive-polarity potential is output to the data signal line in FIG. 1, and in this case, a voltage 8.25 V is output as a potential Vuni.

After the predetermined period T ends, and the predetermined potential Vuni has been applied from the data output circuit, a data signal supply period starts. When initial data DATAn(R) is supplied to the data signal line RSLn, the data signal line RSLn starts being charged from the state where it is preliminary charged to the potential Vuni. It is therefore possible to reduce a difference between the potential of the data signal and the potential of the data signal line when a data signal starts being supplied, as compared to the case where the data signal starts being supplied from the state of the negative-polarity, and potential fluctuations of the data signal line RSLn due to a supply of data DATAn(R) can be suppressed. Upon completing the supply of the data DATAn(R), the data DATAn(G) starts being supplied to the data signal line GSLn. In this case, since the data signal line GSLn is also preliminary charged, potential fluctuations of the data signal line GSLn with a supply of the data DATAn(G) are small. Therefore, while the data DATAn(G) is being supplied, the data signal line RSLn in the floating state is subjected to up-throw potential fluctuations ΔV1' with a supply of the data DATAn(G); however, the up-throw potential fluctuations ΔV1' are smaller than up-throw potential fluctuations ΔV1 of FIG. 10.

Upon completing the supply of the data DATAn(G), the data DATAn(B) starts being supplied to the data signal line BSLn. In this case, since the data signal line GBLn is also preliminary charged, potential fluctuations of the data signal line BSLn with a supply of the data DATAn(G) are small. Therefore, the data signal line RSLn in the floating state while the data DATAn(B) being supplied is subjected to up-throw potential fluctuations ΔV2' with a supply of the data DATAn (B); however, the up-throw potential fluctuations ΔV2' as accumulated with a supply of the data DATAn(B) are smaller than up-throw potential fluctuations ΔV2 of FIG. 10. Similarly, the data signal line GSLn in the floating state while the data DATAn(B) being supplied is subjected to up-throw potential fluctuations ΔV3' with a supply of the data DATAn (B); however, the up-throw potential fluctuations ΔV3' with a supply of the data DATAn(B) are smaller than up-throw potential fluctuations ΔV3 of FIG. 10.

In the next horizontal period, a negative-polarity data signal is supplied, and a preliminary charge is performed with the potential Vuni of 3.75 V in the predetermined period T. Here, the waveform of potential fluctuations of each data signal line are up-side-down corresponding to the predetermined period T of FIG. 1. Here, it is possible to suppresss up-throw potential fluctuations.

According to the present embodiment, data signal lines in all the groups can be charged to the potential Vuni at the same time, and it is therefore possible to suppress up-throw potential fluctuations and down-throw potential fluctuations due to the effect of the data signal line of the adjacent pair.

In the foregoing manner, the potential Vuni is switched between two levels for one horizontal period, and the potential Vuni is set to an AC potential. When the data signal is supplied to the data signal line, potential fluctuations of the data signal line become smaller when the potentials are changed from the positive-polarity to the positive-polarity or from the negative-polarity to the negative-polarity as compared to the case where the potentials are changed from the negative-polarity to the positive-polarity or from the positive-polarity to the negative-polarity. As a result, it is therefore possible to reduce up-throw potential fluctuations and down-throw potential fluctuations which the data signal line to which a data signal is supplied affects other data signal lines. It is therefore preferable that potential fluctuations of the data signal line to which data signal is supplied be minimized.

The polarity in the positive-polarity range or in the negative-polarity range supplied as a data signal is determined based on the display content. However, for example, for such distribution of the used potential that an average potential in the potential range is used most, to reduce an expected value between an potential of the data signal and a potential Vuni, it is preferable that a potential around an average value in the potential range is used as a potential Vuni. As a result, when supplying a positive-polarity data signal and when supplying a negative-polarity data signal, it is very likely that a difference between the potential of the data signal and the potential Vuni be small, thereby more desirably stabilizing the potential of the data signal line.

In the above example, explanations will be given through the case of two potential ranges of the data signal. However, the number of potential ranges are not limited to two, and in the case of selecting the potential of the data signal from the plurality of potential ranges, by setting the potential Vuni to the AC potential corresponding to the number of potential ranges, it is possible to stabilize the potential of the data signal line corresponding to each potential range.

Incidentally, in the timing chart of FIG. 1, the predetermined period T for charging is set in the selection period of the scanning signal line GLi. However, the present invention is not intended to be limited to the foregoing preferred structure, and the predetermined period T may be set outside the selection period of the scanning signal line GLi. As described, the liquid crystal display in the SSD method corresponds to the driving method for high resolution display. Therefore, a large number of data signal lines are closely packed together, and each pixel has a small area. Therefore, the total pixel capacitance of the liquid crystal capacitance 13 and the auxiliary capacitance 14 is smaller than the electrostatic capacitance of the data signal line, and there exists no significant difference from the case of preliminary charging both the data signal line and the pixel as an amount of charge. Therefore, in the case of preliminary charging only a data signal line in advance, and setting ON the TFT 12 only when supplying a data signal, upon completing the supply of the data signal to the pixel, the potential of the data signal line and the pixel is not significantly different form the potential in the case of preliminary charging both the data signal line and the pixel. Therefore, by preliminary charging only the data signal line in the foregoing manner, until the next data signal starts being supplied to the same pixel, the potential of the pixel in the previous horizontal period (1 frame before the subject frame) to which the data signal is supplied can be maintained, thereby realizing a desirable display.

According to the above technical concept, for each data signal line, in the horizontal period directly before the horizontal period of supplying the data signal (horizontal period directly before the subject horizontal period in one frame), it is possible to pre-charge after the data signal supply period of the horizontal period directly before the subject horizontal period. As described, the data signal line in each group may be charged to the potential Vuni by charging in the subsequent data signal supply period before the data DATAn(R) of an initial data signal starts being supplied after the data signal supply period of the group directly before the subject data signal supply period. As a result, when supplying a data signal to the data signal line in the data signal supply period for each horizontal period, by supplying a data signal to each data signal line from the state where the data signal line is charged to the potential Vuni, it is possible to stabilize the potential of the data signal line.

Here, differences between the prior art document 2 and the present embodiment will be explained. The object of the prior art document 2 is to solve not the problem of electrostatic capacitive coupling between adjacent data signal lines of the present invention, but the problem with regard to charged potential fluctuations of the pixel due to a short data signal supply period of a data signal to each pixel as can be seen from the descriptions with regard to dot sequential system. Here, the pixel potential after supplying a data signal to the same pixel differs corresponding to the level of the pixel applied after supplying previous data signal to the pixel because a sufficient time for charging to the potential of the data signal to be output from the data signal line driving circuit is not ensured as a data signal supply period to each pixel. Namely, the data signal supply time is fixed, and thus the charging of the pixel by the data signal is stopped too far in advance of the period where the data signal to be output becomes closer to the potential of the data signal in the case where the potential of the pixel at a start of the charging operation is significantly different from the potential of the data signal. This variation in charged potential corresponds to the time constant of the charge as described in the prior art document 2. The foregoing prior art document 2 discloses the structure wherein the potential at the end of the data signal supply period is set to a target value by charging the selective pixel to the same potential at the same time at the beginning of the horizontal period to avoid the charged potential fluctuations.

Figure 10:
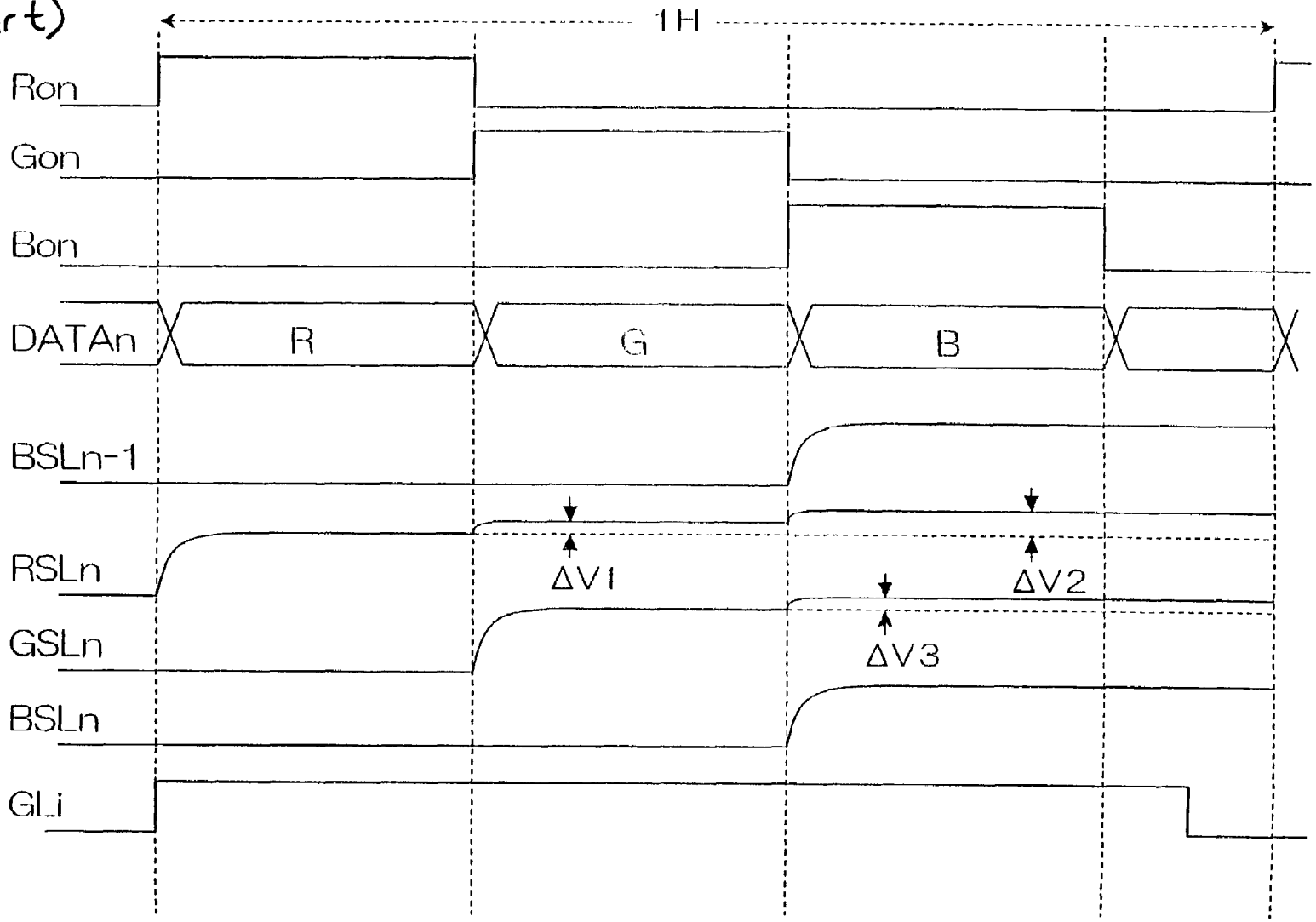
FIG. 10 (Prior Art)
FIG. 10 is a timing chart which explains a conventional driving method of the display panel of FIG. 9.

In contrast, according to the present embodiment, as the SSD method is adopted for the present embodiment, irrespectively of high horizontal frequency with many pixels and a high horizontal frequency, a data signal may be supplied to three data signal lines for R, G and B in one horizontal period, and a sufficient time can be ensured for supplying the data signal to each pixel. In FIGS. 1 and 10, each pixel is charged to the potential of the data DATA output from the data output circuit. This effect can be achieved also because each pixel capacitance is small, and not much time is required for charging each pixel capacitance. Therefore, in one horizontal period sufficient for supplying the data signal to three data signal lines for R, G and B, it is possible to set the length of the predetermined period T in FIG. 1 without much restriction. Therefore, three data signal lines can be charged preliminary from the data output circuit while ensuring a sufficient time for charging each data signal to a potential Vuni to be output from the data output circuit. FIG. 1 shows the state where each data signal line is stabilized to the potential Vuni as being preliminary charged. According to the present invention, as the electrostatic capacitance of the data signal line is sufficiently large with respect to the pixel capacitance, it is important to select the data signal line as a member to be preliminarily charged, which is fundamentally different from the foregoing patent document 2 whose object is to preliminarily charge the pixel.

According to the present embodiment, explanations will be given through the case of 1H inversion driving. According to this driving system, the data signal for inverting the polarity is supplied for each horizontal period, and in the case where the potential of the data signal line is required to change the potential of the data signal line to a large extent for each horizontal period, it is possible to reduce up-throw potential fluctuations and down-throw potential fluctuations, thereby stabilizing the potential of the data signal line. Next, explanations will be given through the case of the source bus line inversion driving and the frame inversion driving.

Figure 2:
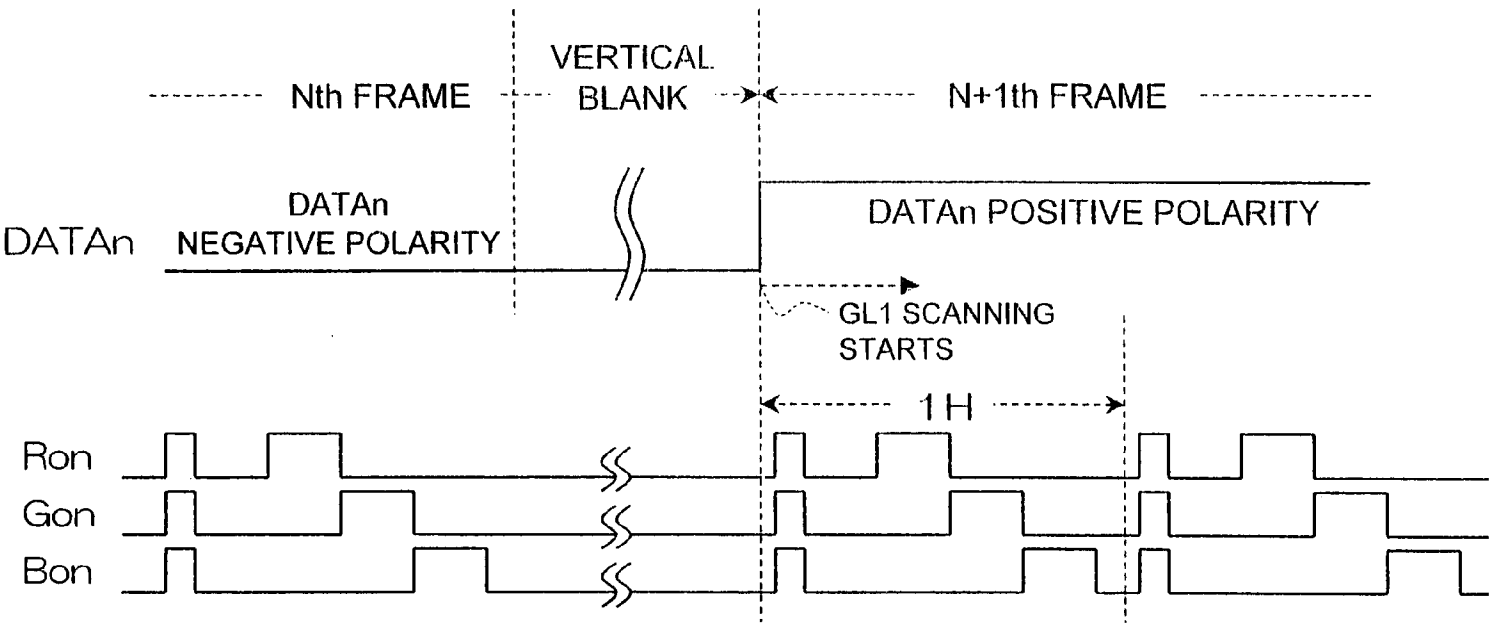
FIG. 2 is a timing chart which explains another driving method of the display panel in accordance with the first embodiment of the present invention.

FIG. 2 shows a timing chart of the source bus line inverse driving and the frame inverse driving. For both the source bus line inverse driving and the frame inverse driving, when the notice is brought to one data signal line (source bus line), the polarity of a data signal inverses for each frame. For example, as shown in FIG. 2, when the data DATAn is in the negative-polarity in the N frame, in the N+1th frame, the polarity of the data DATAn is inversed to the positive-polarity. Therefore, when supplying a data signal in the first horizontal period in each frame by selecting the scanning signal line GL1, the polarity of the potential of the data signal line is inversed. In response, as illustrated in the Figure, by pre-charging as shown in FIG. 1, the data signal line is inevitably preliminary charged with respect to the first horizontal period, thereby suppressing the up-throw potential fluctuations and down-throw potential fluctuations.

Figure 3:
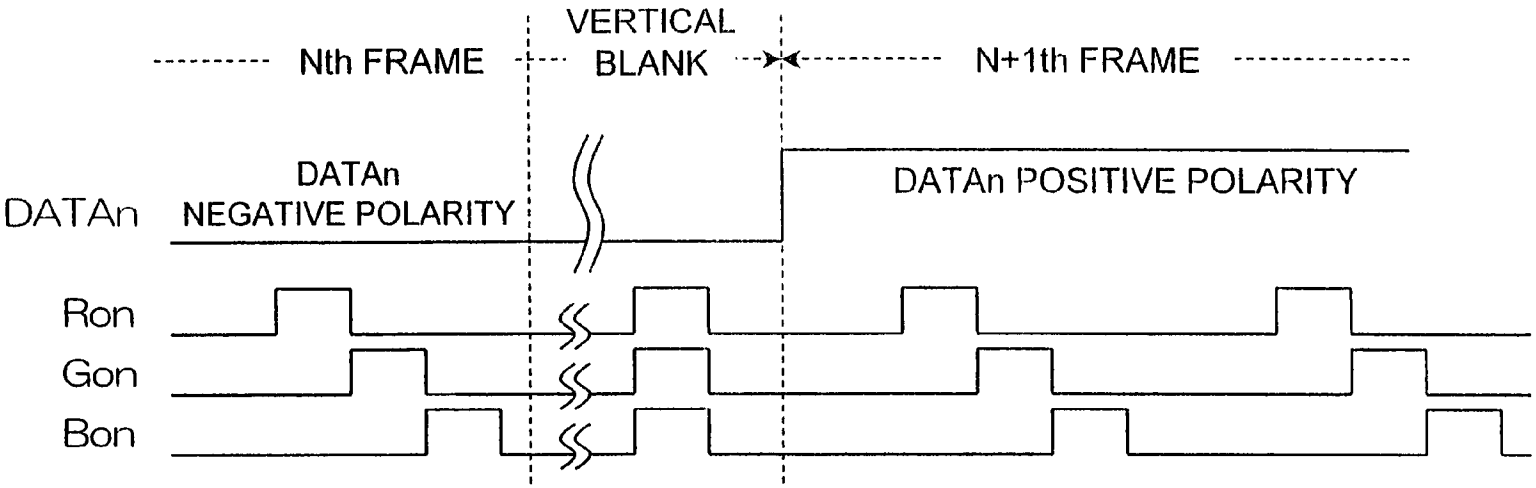
FIG. 3 is a timing chart which explains still another driving method of the display panel in accordance with the first embodiment.

Incidentally, since the polarity of the data signal is inversed in the first horizontal period in each frame, it may be arranged so as to pre-charge only in the vertical blank period as illustrated in FIG. 3. As described, in the present embodiment, the data signal lines in each group are preliminary charged to the predetermined potential in a period between i) after a data signal supply period directly before a predetermined data signal supply period of the group and ii) before a first data signal starts being supplied in the predetermined data signal supply period of the group.

As described, according to the present embodiment, it is possible to pre-charge the data signal lines in each group to the potential Vuni also in the period other than the data signal supply period of the group. Therefore, in the display device which is driven by time-division based on a group of sequentially, it is possible to reduce up-throw potential fluctuations and down-throw potential fluctuations when display.

Furthermore, data signal lines in each group are made up of three data signal lines corresponding to three primary colors of R, G and B which constitute display color. Therefore, the potential of the data signal in three primary colors can be stabilized, thereby realizing an accurate display in a combination of these three primary colors.

Incidentally, in some cases, AC driving may be performed by switching the polarity of the liquid crystal capacitance 13 on the common electrode side between the positive-polarity and the negative-polarity, and selecting the potential on the side of the data signal line from one potential range. As described, the potential on the side of the data signal line can be selected from one potential range by setting the potential Vuni approximately to an average value between the maximum value and the negative value of the potential of the data signal to be supplied to the data signal line. With this structure, it is very likely that the difference between the potential of the data signal and the potential Vuni can be made small, thereby more effectively stabilizing the potential of the data signal line.

Second Embodiment

Figure 11:
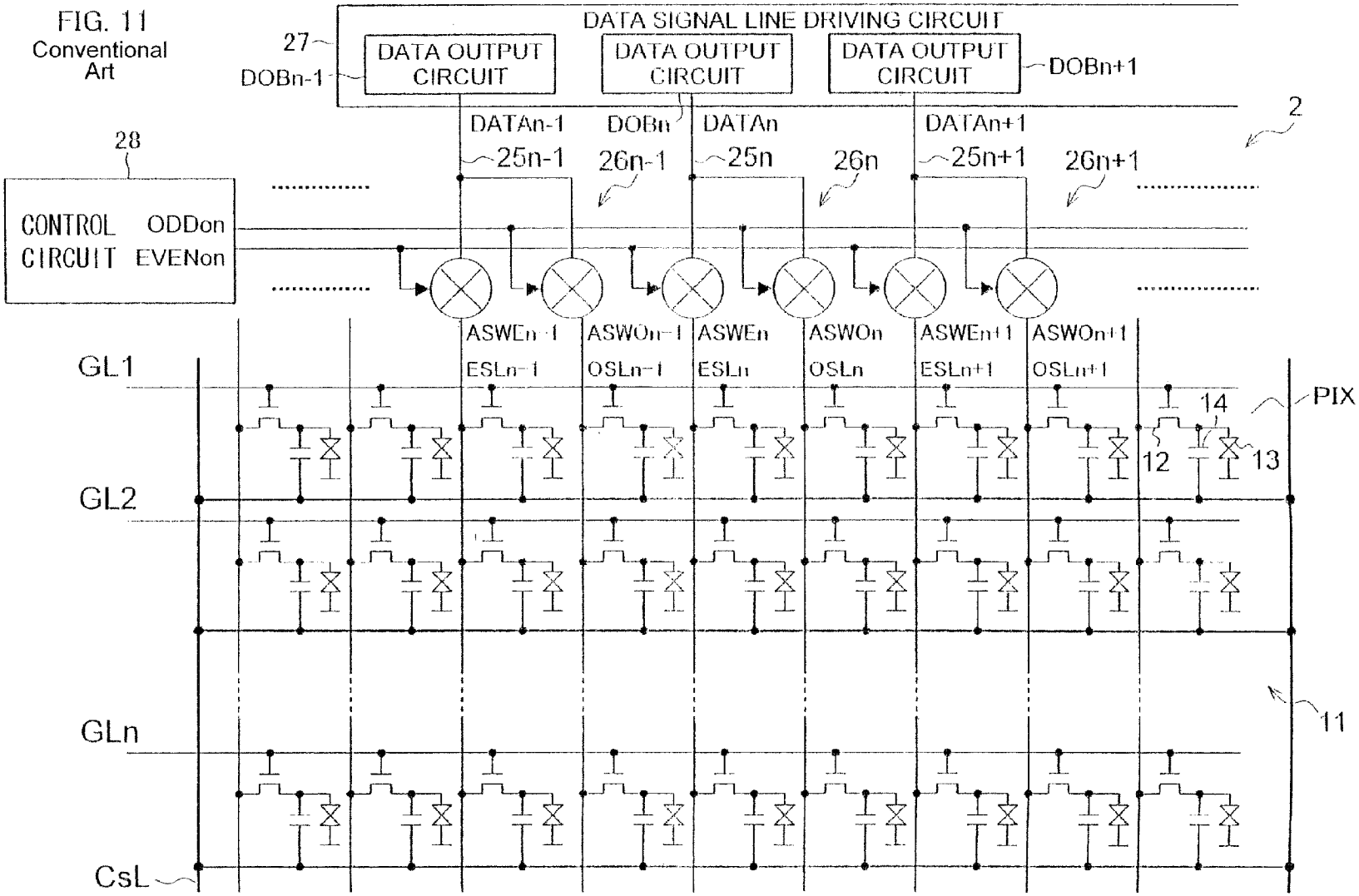
FIG. 11 Conventional Art
FIG. 11 is a block diagram of a circuit which shows another structure of the display panel of the liquid crystal display device adopting the SSD method.

The following will explain another embodiment of the present invention with reference to FIG. 4 through FIG. 11. FIG. 11 shows the structure of a display panel 2 provided in a liquid crystal display device in accordance with the present invention adopting the SSD method. For ease of explanation, members (structures) having the same functions as those shown in the drawings pertaining to the earlier explained conventional structure will be given the same reference symbols, and explanations of the present embodiment will be given for those different from the conventional driving method.

Figure 4:
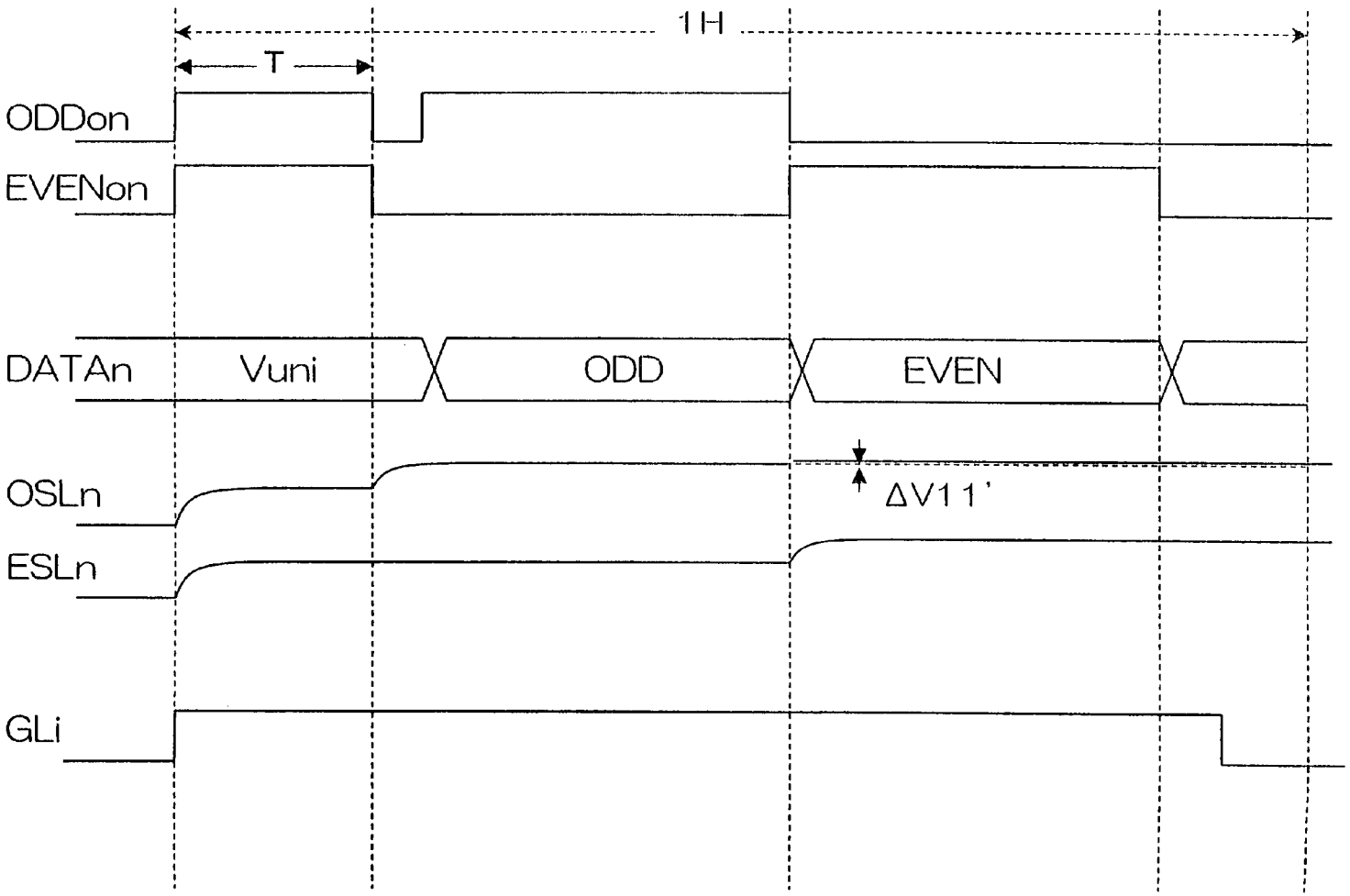
FIG. 4 is a timing chart which explains driving method of a display panel in accordance with the second embodiment of the present invention.

In the present embodiment, the display panel 2 is driven as shown in the timing chart of FIG. 4. Firstly, this timing chart of FIG. 4 will be explained. As in the case of the previous embodiment, the timing chart of FIG. 4 also adopts the 1H inversion driving. Specifically, in each horizontal period, the switching signals ODDon and EVENon are supplied by time-division, so that the conduct period of the analog switches ASWOn and ASWEn transit in this order, and the DATAn (ODD) and DATAn(Even) are sequentially supplied to data signal lines OSLn and ESLn. In the present embodiment, in each horizontal period, before the data signal supply period in which switching signals ODDon and EVENon are supplied to output these data signals, the switching signals ODDon and EVENon are supplied in the predetermined period T at the same time, to conduct the analog switches ASWOn, and ASWEn at the same time. The foregoing operation is performed simultaneously for respective groups of data signal lines.

Then, in this predetermined period T, a potential (predetermined potential) Vuni is applied to each data signal line via a common wiring 25 from the data output circuit DOBn in each group. As illustrated in FIG. 4, in the predetermined period T, each data signal line is stably preliminary charged to a potential Vuni. Here, each data signal line is preliminary charged when a selection signal of the scanning signal line GLi is output. Therefore, the pixel as selected is charged so that the data signal line side is set to a predetermined potential Vuni. The value of this potential Vuni is as described in the present embodiment.

Figure 12:
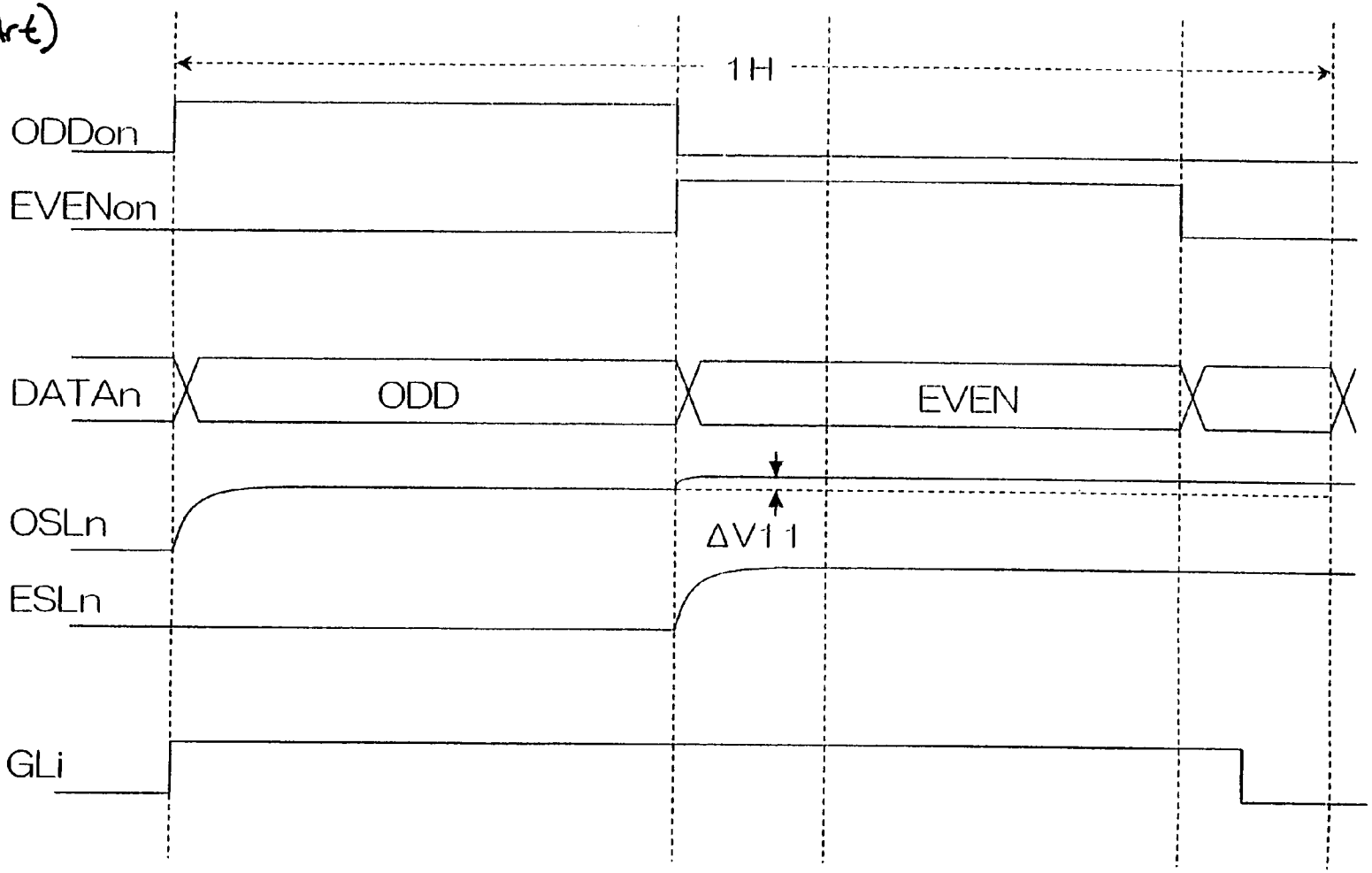
FIG. 12 (Prior Art)
FIG. 12 is a timing chart which explains a conventional driving system of the display panel of FIG. 11.

After the predetermined period T ends, and the predetermined potential Vuni has been applied from the data output circuit DOBn, a data signal supply period starts. When initial data DATAn(ODD) is supplied to the data signal line OSLn, the data signal line OSLn starts being charged from the state where it is preliminary-charged to the potential Vuni. It is therefore possible to reduce a difference between the potential of the data signal and the potential of the data signal line when a supply of a data signal is started, as compared to the case where a supply of the data signal is started from the state of the negative-polarity, and potential fluctuations of the data signal line OSLn due to a supply of data DATAn(ODD) can be suppressed. Upon completing the supply of the data DATAn (ODD), the data DATAn(EVEN) starts being supplied to the data signal line ESLn. In this case, since the data signal line ESLn is also preliminary-charged, potential fluctuations of the data signal line ESLn with a supply of the data DATAn (EVEN) are small. Therefore, while the data DATAn(EVEN) is being supplied, the data signal line OSLn in the floating state is subjected to up-throw potential fluctuations ΔV11' with a supply of the data DATAn(even); however, the up-throw potential fluctuations ΔV11' are smaller than up-throw potential fluctuations ΔV11 of FIG. 12.

In the next horizontal period, a data signal in the negative-polarity is supplied, and a preliminary charge is performed with the potential Vuni in the negative-polarity in the predetermined period T. Here, the waveform of potential fluctuations of each data signal line is up-side-down corresponding to the predetermined period T of FIG. 4. Here, it is possible to reduce down-throw potential fluctuations.

According to the present embodiment, data signal lines in all the groups can be charged to the potential Vuni at the same time, and it is therefore possible to reduce up-throw potential fluctuations and down-throw potential fluctuations due to the effect of the data signal line of the adjacent pair.

Incidentally, in the timing chart of FIG. 4, the predetermined period T for charging is set in the selection period of the scanning signal line GLi. However, the present invention is not intended to be limited to the foregoing preferred structure, and the predetermined period T may be set outside the selection period of the scanning signal line GLi as in the first embodiment. As described, the data signal lines in each group may be charged to the potential Vuni by charging in the subsequent data signal supply period before the data DATAn (ODD) of an initial data signal starts being supplied after the data signal supply period of each group directly before the subject data signal supply period. As a result, when supplying a data signal to the data signal line in the data signal supply period for each horizontal period, a data signal is supplied to each data signal line from the state where the data signal line is charged to the potential Vuni, thereby stabilizing the potential of the data signal line.

The source bus line inverse driving and the frame bus line driving in the present embodiment are as explained in the first embodiment.

As described, according to the present embodiment, it is possible to pre-charge the data signal line in each group to the potential Vuni also in the period other than the data signal supply period of the group. Therefore, in the display device adopting a time-division driving using a plurality of sequential data signal lines in a group, it is possible to reduce up-throw potential fluctuations and down-throw potential fluctuations when display.

Furthermore, data signal lines in each group are made up of adjacent two data signal lines. Therefore, when displaying in a combination of three primary colors, it is possible to display in an accurate color without the problem of generating significant color deviation caused by up-throw potential fluctuations and down-throw potential fluctuations of the data signal lines associated with the conventional structure where data signal lines corresponding to three primary colors do not belong in the same group.

Third Embodiment

Figure 5:
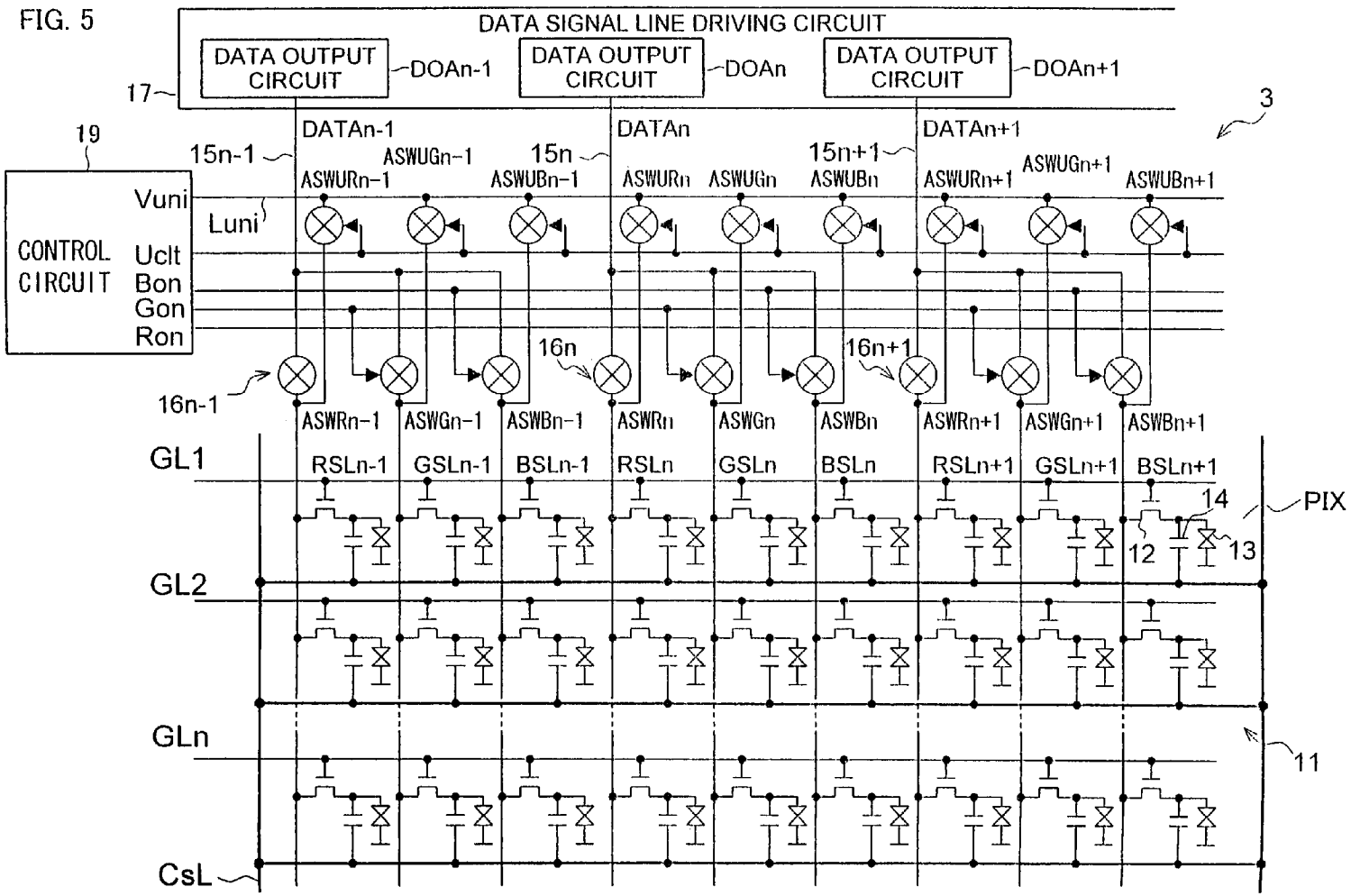
FIG. 5 is a block diagram of a circuit which shows the structure of a display panel in accordance with the third embodiment of the present invention.
Figure 6:
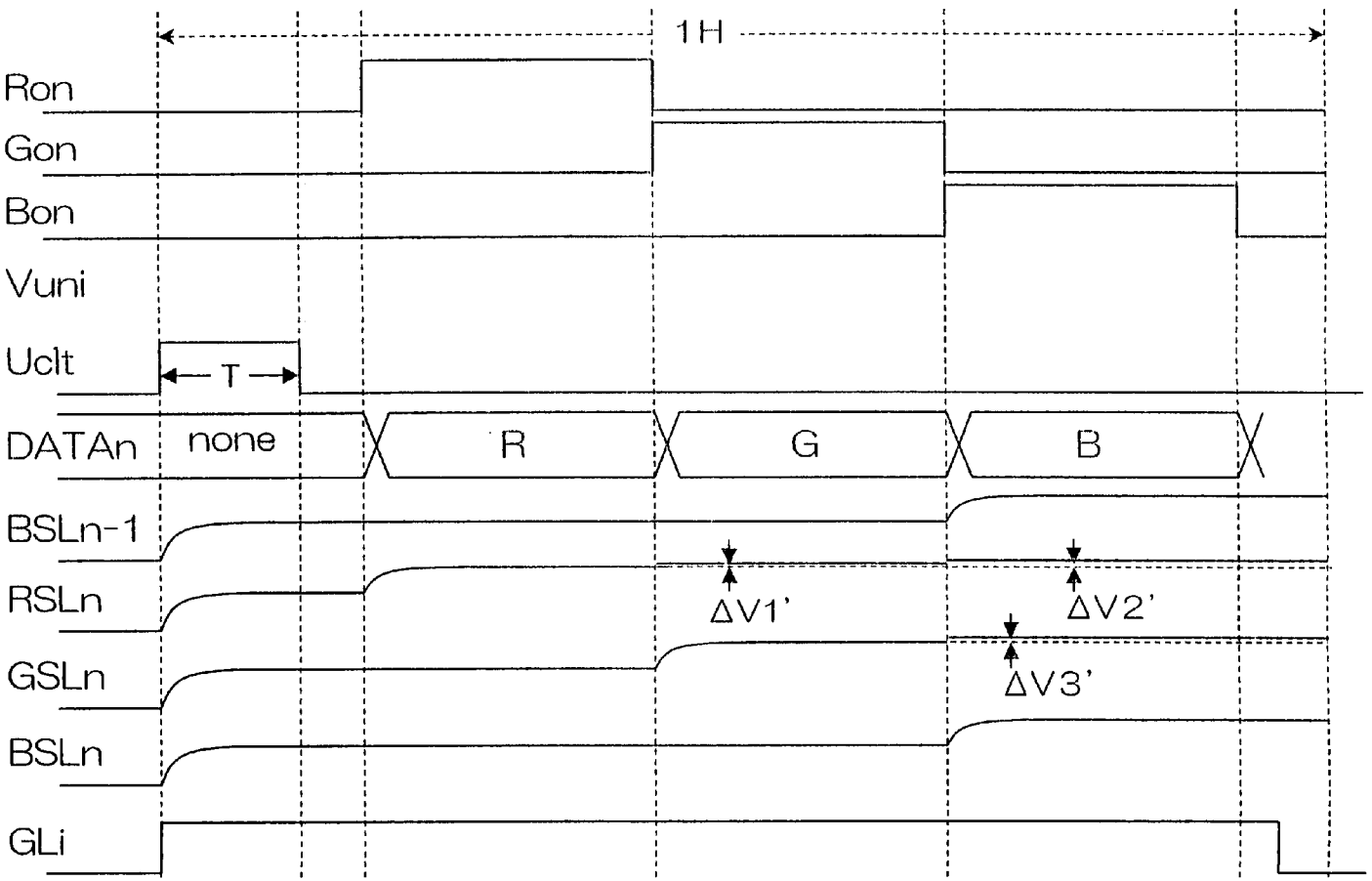
FIG. 6 is a timing chart which explains the driving method of the display panel in accordance with the third embodiment of the present invention.

The following will explain still another embodiment of the present invention with reference to FIGS. 5 and 6. FIG. 5 shows the structure of a display panel 3 provided in a liquid crystal display device in accordance with the present embodiment adopting the SSD method. For ease of explanation, members (structures) having the same functions as those of the display panel 1 of FIG. 9 pertaining to the earlier explained conventional structure will be given the same reference symbols, and explanations of the present embodiment will be given for those different from the conventional driving method.

The display panel 3 has the structure of FIG. 9 and further includes a potential line Luni, and each data signal line is connected to the potential line Luni via an analog switch (auxiliary switch) ASWU different from the analog switches ASW.

The potential line Luni is arranged so as to apply a potential Vuni described in the first embodiment. An analog switch ASWU is provided corresponding to each data signal line, and, for example, analog switches ASWURn, ASWUGn and ASWUBn are provided corresponding to data signal lines RSLn, GSLn and BSLn of the nth group. This analog switch ASWU is provided between one end of the data signal line on the side of the data signal line driving circuit 17 (on the upstream side in the direction of supplying data signal) and the potential line Luni, and the analog switch ASWU conducts or shuts off between the end of the data signal line and the potential line Luni. The conduct/shut-off of the analog switch ASWU is controlled by a switching signal Uclt which is used in common among all the analog switches ASWU of the display panel 3. A control circuit 19 outputs switching signals Ron, Gon, Bon and Uclt. The potential Vuni is applied, not from the data output circuit DOA but from, for example, the control circuit 19.

In the present embodiment, the display panel 3 is driven as shown in the timing chart of FIG. 6. Firstly, the timing chart of FIG. 6 will be explained. As in the case of the previous embodiment, the timing chart of FIG. 6 also adopts the 1H inversion driving. Specifically, in each horizontal period, the switching signals Ron, Gon and Bon are supplied by time-division, so that the conduct period of the analog switches ASWRn, ASWGn and ASWBn transit in this order, and the DATAn(R), DATAn(D) and DATAn(B) are sequentially supplied to data signal lines RSLn, GSLn and BSLn. In the present embodiment, in each horizontal period, before the data signal supply period in which switching signals Ron, Gon and Bon are set in the ON period for outputting these data signals, the switching signals Ron, Gon and Bon are supplied in the predetermined period T at the same time, to conduct the analog switches ASWRn, ASWGn and ASWBn at the same time. The foregoing operation is performed simultaneously for respective groups of data signal lines. In FIG. 6, the potential line Luni is set the potential Vuni throughout the horizontal period; however, the same effect can be achieved as long as the potential line Lunit is set the potential Vuni at least in the predetermined period T. As a result, in the predetermined time T, the potential Vuni is applied from the potential line Luni to each data signal line via the analog switch ASWU. As shown in FIG. 6, in the predetermined period T, each data signal line is stably preliminary-charged to the potential Vuni.

The operation of supplying a data signal after pre-charging is the same as those of the first embodiment, and up-throw potential fluctuations ΔV1', ΔV2'and ΔV3' are small. Similarly, down-throw potential fluctuations are also small.

As described, according to the present embodiment, it is possible to pre-charge the data signal line in each group to the potential Vuni also in the period other than the data signal supply period of the group. Therefore, in the display device adopting a time-division driving using a plurality of sequential data signal lines in a group, it is possible to suppress up-throw potential fluctuations and down-throw potential fluctuations when display. Furthermore, the present embodiment also offer other effects as achieved from the structure of the first embodiment.

In response to the foregoing structure wherein the scanning signal line GLi may be preliminary-charged in the period outside the selection period of the scanning signal line GLi, the analog switches ASWU in each group of data signal lines conduct in the period after the data signal supply period directly before a predetermined data signal supply period in each group before a first data signal in each group starts being supplied in the predetermined data signal supply period.

Fourth Embodiment

The following will explain still another embodiment of the present invention with reference to FIGS. 7 and 8. FIG. 7 shows the structure of a display panel 4 provided in a liquid crystal display device in accordance with the present invention adopting the SSD method. For ease of explanation, members (structures) having the same functions as those of the display panel 2 shown in FIG. 11 pertaining to the earlier explained conventional structure will be given the same reference symbols, and explanations of the driving method of the present embodiment will be given for those different from the conventional driving method. The display panel 4 has the structure of FIG. 11 and further includes a potential line Luni, and each data signal line is connected to the potential line Luni via an analog switch (auxiliary switch) ASWU different from the analog switch ASW.

As explained in the third embodiment, the potential line Luni is arranged so as to apply a potential Vuni described in the first embodiment. An analog switch ASWU is provided corresponding to each data signal line, and, for example, analog switches ASWUOn and ASWUEn are provided corresponding to data signal lines OSLn and ESLn in the nth group. This analog switch ASWU is provided between one end of the data signal line on the side of the data signal line driving circuit 27 (on the upstream side in the direction of supplying data signal) and the potential line Luni, and the analog switch ASWU conducts or shuts off between the end of the data signal line and the potential line Luni. The conduct/shut-off of the analog switch ASWU is controlled by a switching signal Uclt which is used in common among all the analog switches ASWU of the display panel 4. A control circuit 29 outputs switching signals ODDon, EVENon and Uclt. The potential Vuni is applied, not from the data output circuit DOB but from, for example, the control circuit 29.

In the foregoing embodiment, this display panel 4 is driven as shown in the timing chart of FIG. 8. Firstly, the timing chart of FIG. 8 will be explained. As in the case of the previous embodiment, the timing chart of FIG. 8 also adopts the 1H inversion driving system. Specifically, in each horizontal period, the switching signals ODDon and EVENon are supplied by time-division, so that the conduct period of the analog switches ASWOn and ASWEn transit in this order, and the DATAn(ODD) and DATAn(Even) are sequentially supplied to data signal lines OSLn and ESLn. In FIG. 8, the potential line Luni is set in the potential Vuni throughout the horizontal period; however, the same effect can be achieved as long as the potential line Lunit is set in the potential Vuni at least in the predetermined period T. As a result, in the predetermined time T, the potential Vuni is applied from the potential line Luni to each data signal line via the analog switch ASWU. As shown in FIG. 8, in the predetermined period T, each data signal line is stably preliminary charged to the potential Vuni.

The operation of supplying a data signal after pre-charging is the same as those of the second embodiment, and up-throw potential fluctuations ΔV11' are small. Similarly, down-throw potential fluctuations are also small.

As described, according to the present embodiment, it is possible to pre-charge the data signal line in each group to the potential Vuni also in the period other than the data signal supply period of the group. Therefore, in the display device driven by time-division based on a group of a plurality of sequentially provided data signal lines, it is possible to reduce up-throw potential fluctuations and down-throw potential fluctuations when display as in the case of the second embodiment.

In response to the foregoing structure wherein the scanning signal line GLi may be preliminary charged in the period outside the selection period of the scanning signal line GLi, the analog switches ASWU in each group of data signal lines conduct in the period between i) after a data signal supply period directly before a predetermined data signal supply period of the group and ii) before a first data signal starts being supplied in the predetermined data signal supply period of the group.

Fifth Embodiment

Figure 13:
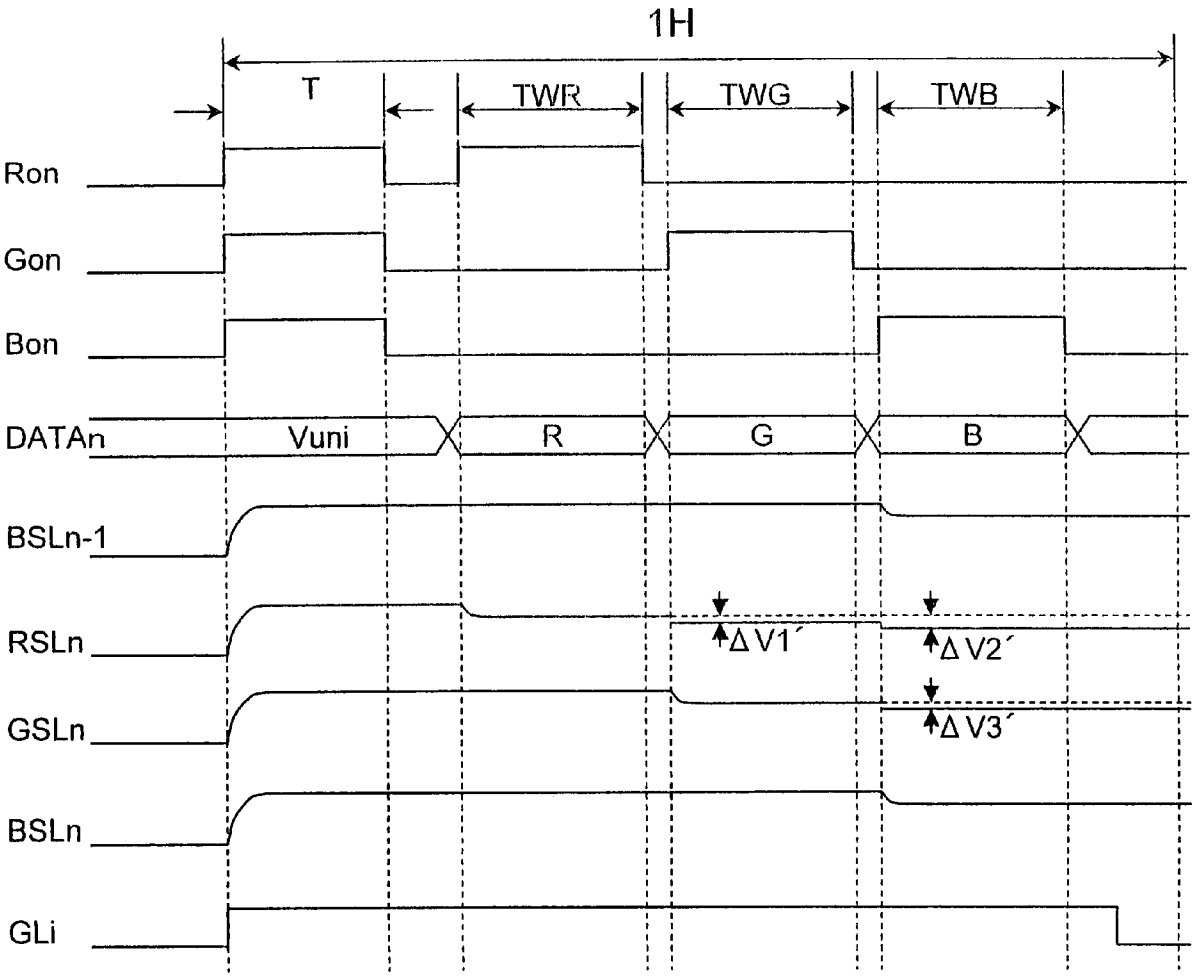
FIG. 13 is a timing chart which explains a driving method of a display panel, in accordance with the fifth embodiment of the present invention.
Figure 15:
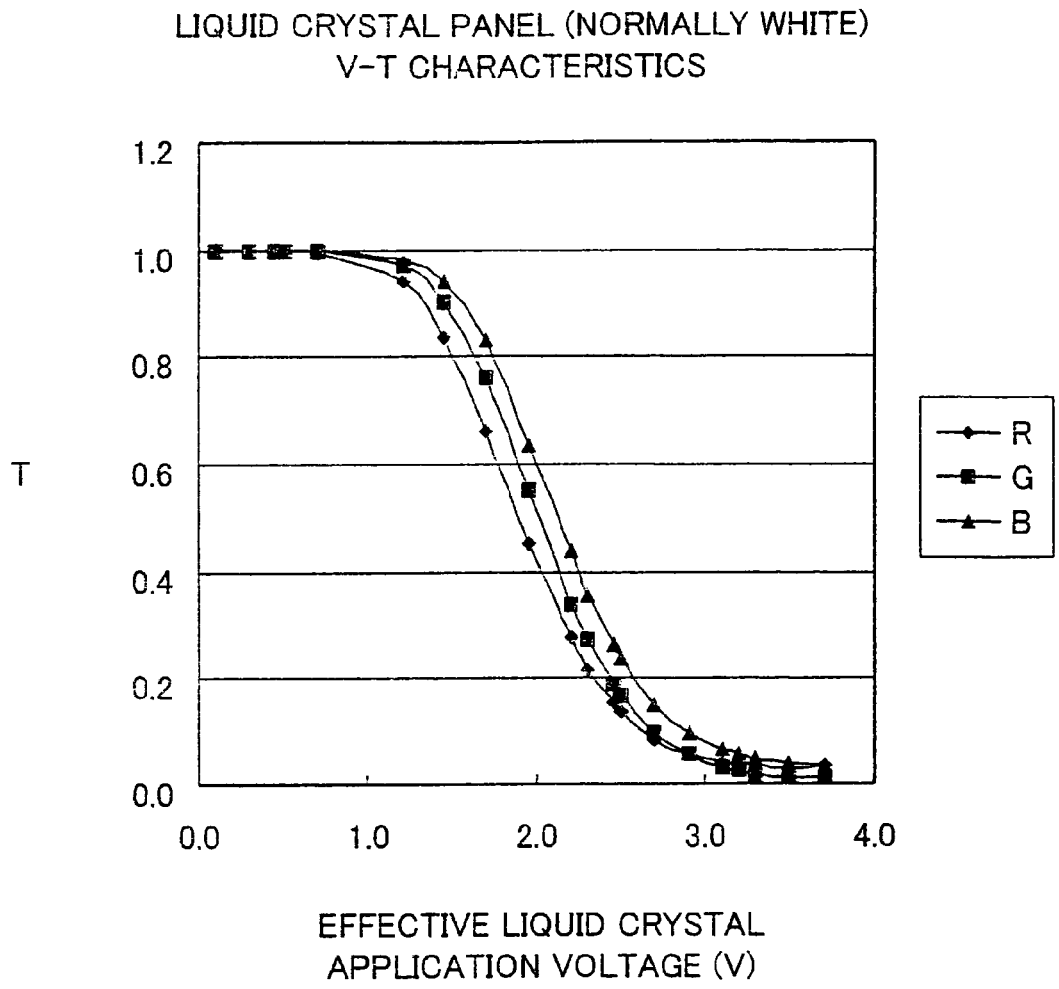
FIG. 15 is a graph which shows the relationship between a transmittance of liquid crystal and a liquid crystal application voltage.

The following will explain still another embodiment of the present invention with reference to FIGS. 9, 13 and 15.

The driving method of the display device in accordance with the present embodiment is the same as the one explained in the first embodiment with reference to the timing chart of FIG. 9. First, the timing chart of FIG. 13 of the present embodiment will be explained. In FIG. 13, Ron, Gon and Bon indicate switching signals for use in controlling analog switches ASWRn, ASWGn and ASWBn. The DATAn is to be supplied to each of the data signal lines RSLn, GSLn and BSLn for R, G and B, respectively in the nth group. Hereinafter, VRSLn, VGSLn and VBSLn indicate potentials of data signal lines RSLn, GSLn and BSLn for R, G and B respectively in the nth group. GLi indicates a waveform when the gate line in the i-stage is selected. In the present embodiment, before a predetermined data signal is supplied to each of the data signal lines for R, G and B in each horizontal period, switching signals Ron, Gon and Bon are supplied in the predetermined period T, to pre-charge the data signal lines RSLn, GSLn and BSLn to the predetermined potential Vuni in advance.

As a value of the predetermined potential Vuni, a maximum value in the acceptable positive-polarity potential range is set for the data DATAn of positive-polarity, while a minimum value in the acceptable positive-polarity potential range is set for the positive-polarity data DATAn. Namely, in the case where the positive-polarity potential range is in a range of 6 V to 10.5 V, and the negative-polarity potential range is in a range of 1.5 V to 6 V in the 1H inversion driving, the maximum value of 10.5 V is set for the positive-polarity, and the minimum value of 1.5 V is set for the negative-polarity. Incidentally, a voltage to be applied to an element provided in each pixel by a charged voltage of the data signal line is a potential difference between the predetermined potential Vuni and a reference potential, and the predetermined potential Vuni is therefore to be set up a potential that maximizes the voltage to be applied to the element, which is a potential most apart from the reference potential in an acceptable range of potential to be applied to the data signal line in each data signal supply period.

According to the foregoing method, in the predetermined time T after the data output circuit DOAn of the data signal line driving circuit 17 starts applying the potential Vuni, the data signal lines RSLn, GSLn and BSLn for R, G and B are respectively stabilized to the potential Vuni. Therefore, with respect to the predetermined period T, a sufficient value for charging each data signal line to the predetermined potential Vuni is set.

After the foregoing predetermined period T ends, the data signal supply period starts. When the initial data DATAn (R) is supplied to the data signal line RSLn, the data signal line RSLn starts being charged by the data signal from the state already preliminary charged to the potential Vuni. In the case where the data signal line is not preliminary charged, the data signal in positive (negative) polarity is written from the state where it is charged to the negative (positive) polarity in the previous frame, while in the case where the data signal line is preliminary charged, positive-polarity (negative-plarity) data is written from the state where it is charged to the positive (negative) polarity with the data of the maximum value. As a result, it is possible to suppress fluctuations in the potential VRSLn of the data signal line RSLn when supplying the data DATAn(R).

Upon completing the supply of the data DATAn(R), the data DATAn(G) starts being supplied to the data signal line GSLn. Here, as the data signal line GSLn is preliminary charged in the same manner as when supplying the data DATAn(R), it is possible to reduce fluctuations of the potential VGSLn of the data signal line GSLn. Therefore, the data signal line RSLn in the floating state in the supply period of the data DATAn(G), the up-throw potential fluctuations ΔV1' due to the supply of the data DATAn(G) are smaller than up-throw potential fluctuations ΔV1 of FIG. 10.

Upon completing the supply of the data DATAn(G), the data DATAn(B) starts being supplied to the data signal line BSLn. Here, as the data signal line BSLn is preliminary charged, it is possible to reduce fluctuations of the potential VBSLn of the data signal line BSLn. Therefore, the data signal line RSLn in the floating state in the supply period of the data DATAn(B), the accumulated down-throw potential fluctuations ΔV2' due to the supply of the data DATAn(B) are smaller than down-throw potential fluctuations ΔV2 of FIG. 10. Also, the data signal line GSLn in the floating state in the supply period of the data DATAn(B), the down-throw potential fluctuations ΔV3' due to the supply of the data DATAn(B) are smaller than down-throw potential fluctuations ΔV3 of FIG. 10. Therefore, resulting potential fluctuations in the 1H period can be suppressed as compared to the case of FIG. 10. Incidentally, small up-throw potential fluctuations occur in the case of negative-polarity.

FIG. 15 shows the characteristic curve (V-T curve) showing the relationship between the transmittance of liquid crystal and liquid crystal application voltage. As can be seen from FIG. 15, the V-T curve shifts to the right in the order of R, G and B. This is because, the index of refraction differs depending on the transmission wavelength in one of the colors R, G and B. Specifically, R has a long wavelength, and B has a short wavelength, with respect to the same application voltage, the transmittances TR, TG and TB in respective colors R, G and B with an application of the same voltage hold the relationship of TR<TG<TB. According to the potential fluctuations of the data signal line of FIG. 10 in the conventional structure, the potential VRSLn of the data signal line RSLn is subjected to up-throw potential fluctuations two times, and the potential is varied by ΔV2, and the data signal line GSLn is subjected to up-throw potential fluctuations one time, and the potential is varied by ΔV3, and the data signal line BSLn is not subjected to up-throw potential fluctuations even once.

Therefore, both the potential VRSLn of the data signal line and the potential VGSLn of the data signal line GSLn change in the direction of increasing the potential, and, for example, for the normally white display, change to the black. This feature emphasizes the initial characteristic of shifting the potential in the order of TR<TG<TB with an applied fixed voltage, the display color would be bluish tint. In contrast, according to the present embodiment, by charging the data signal line to the maximum positive-polarity potential or the minimum negative-polarity potential. With this structure, potential fluctuations occur in the direction of reducing the polarity in the case of positive polarity; on the other hand, potential fluctuations occur in the direction of increasing the polarity in the case of negative polarity. As a result, the foregoing initial characteristic of shifting the potential in the order of TR<TG<TB with an applied fixed voltage can be recovered, thereby obtaining a desirable display quality without the problem of tint difference.

Here, difference between the present embodiment and the prior art document 3 will be explained. An object of the prior art document 3 is to solve the problem of different potential states between a border of blocks and an area surrounding it, which is caused by a potential oscillation of a signal line on the border of the blocks when transferring data per block. As a means to solve the problem, the prior art document 3 teaches the structure wherein a preliminary polarity inversion period is provided for inverting the polarity in advance, prior to the normal polarity inversion period, thereby suppressing up-throw potential fluctuations.

In contrast, according to the driving method of the present embodiment, by utilizing the up-throw potential fluctuations as achieved after charging the maximum potential in the positive polarity range or to the minimum potential in the negative polarity range, to achieve the effect of improving the differences in color.

Sixth Embodiment

Figure 14:
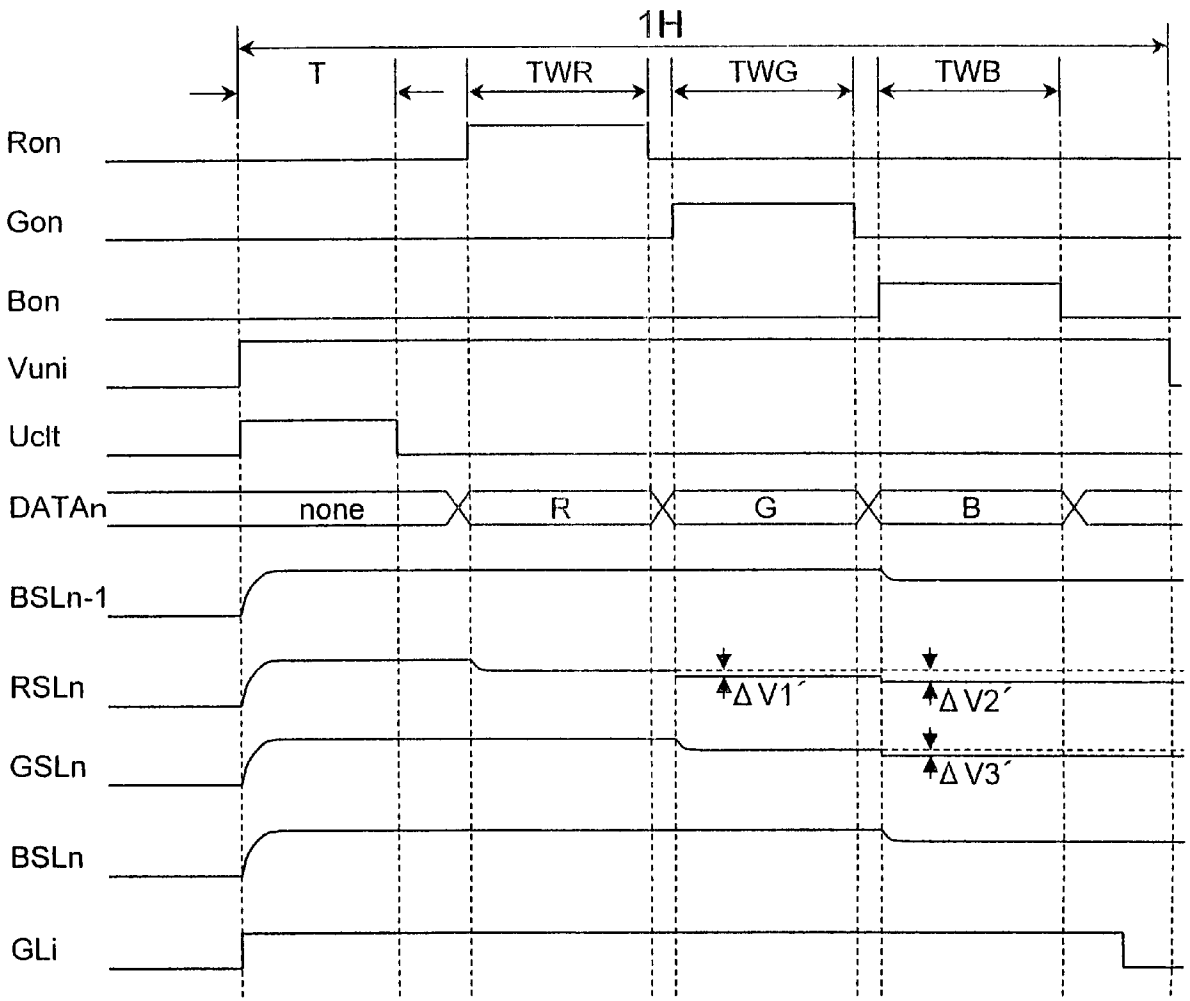
FIG. 14 is a timing chart which explains a driving method of a display panel in accordance with the sixth embodiment of the present invention.

The following will explain still another embodiment of the present invention with reference to FIGS. 5, 14 and 15.

In the present embodiment, the structure of the liquid crystal panel adopted in the present embodiment has the same structure as the one shown in FIG. 5 adopted in the third embodiment. The timing chart of FIG. 14 will be explained. As in the case of the previous embodiments, the timing chart of FIG. 14 also adopts the 1H inversion driving. Specifically, in each horizontal period, the switching signals Ron, Gon and Bon are supplied by time-division, so that the conduct period of the analog switches ASWRn, ASWGn and ASWBn transits in this order, and the DATAn(R), DATAn(D) and DATAn(B) are sequentially supplied to data signal lines RSLn, GSLn and BSLn. In the present embodiment, in each horizontal period, before the data signal supply period in which switching signals Ron, Gon and Bon are set in the ON period for outputting these data signals, the switching signals Uclt are supplied in the predetermined period T, to conduct the analog switches ASWRn, ASWGn and ASWBn at the same time. The foregoing operation is performed simultaneously for respective groups of data signal lines.

As a value of the predetermined potential Vuni, a maximum value in the acceptable positive-polarity potential range is set for the positive-polarity data DATAn, while a minimum value in the acceptable negative-polarity potential range is set for the negative-polarity data DATAn. Namely, in the case where the positive-polarity potential range is set in a range of 6 V to 10.5 V, and the negative-polarity potential range is in a range of 1.5 V to 6 V in the 1H inversion driving, the maximum value of 10.5 V is set for the positive-polarity data DATAn, and the minimum value of 1.5 V is set for the negative-polarity data DATAn. Incidentally, a voltage to be applied to an element provided in each pixel by a charged voltage of the data signal line is a potential difference between the predetermined potential Vuni and a reference potential, and the predetermined potential Vuni is therefore to be set up a potential that maximizes the voltage to be applied to the element, which is a potential most apart from the reference potential in an acceptable range of potential to be applied to the data signal line in each data signal supply period. With this structure, in the predetermined period T, the predetermined potential Vuni is supplied to each data signal line via the corresponding analog switch ASWN from the potential line Vuni.

The operating of supplying a data signal after pre-charging is the same as the fifth embodiment. Namely, in the positive polarity, down-throw potential fluctuations $\Delta V1'$, $\Delta V2'$ and $\Delta V1'$ are also small. Then, as described in FIG. 15, a tint difference is hardly observed. Similarly, in the negative polarity, small up-throw potential fluctuations occur, and the similar effect therefore can be achieved.

According to the structure of the fifth embodiment, it is necessary to adjust, for example, the inside of the driver (video signal, sampling pulse timing) for the preliminary charging. In contrast, according to the structure of the present embodiment, a power supply system for the preliminary charging can be designed as a completely different system from the conventional driver adopted in the 3SSD driving, and therefore a design margin can be ensured.

Overview of the Embodiments

As described, the display device in accordance with the present embodiment is arranged such that a plurality of pixels are provided respectively at intersections of a plurality of data signal lines and a plurality of scanning signal lines; a plurality of data signal lines divided into a plurality of groups, each group being made up of sequentially provided data signal lines, and a plurality of switches are provided respectively for the plurality of data signal lines in the group on an upstream side in a direction of supplying a data signal, and respective ends of the plurality of switches in the group of data signal lines, on the upstream side in the direction of supplying of the data signal are mutually connected, wherein the plurality of data signal lines in the group can be charged to a predetermined potential in a period other than a data signal supply period of the group.

With this structure, data signal lines in each group can be charged to a predetermined potential in a period other than the data signal supply period of the group. Therefore, by switching each switch to a data signal line in the group, it is possible to charge all the data signal lines in the group to a predetermined potential before a data signal supply period for supplying a data signal by time-division. In this structure, by setting the predetermined potential to a potential approximate to the potential to be applied to the data signal line in the data signal supply period, potential fluctuations to be applied to each data signal line due to the supply of a data signal in the data signal supply period can be made smaller as compared to the potential fluctuations from the potential of the data signal lines directly before supplying a data signal in the case where the data signal lines are not charged to the predetermined potential. As a result, it is possible to avoid the problem associated with the supply of a data signal to data signal lines in each group, i.e., the data signal lines to which a data signal has been supplied are subjected to large potential fluctuations due to the electrostatic coupling of the data signal lines. Furthermore, by charging data signal lines in all the groups to a predetermined potential at the same time, it is possible to suppress the effects from the data signal lines in the adjacent group.

With the foregoing structure, it is possible to realize a display device wherein data signal lines are driven by time-division based on a group of sequentially provided data signal lines, which permit up-throw potential fluctuations and down-throw potential fluctuations when display to be suppressed.

Incidentally, it is preferable that each group is made up of three data signal lines respectively corresponding to three primary colors which constitute a display color. With this structure, potentials of the data signals for three primary colors can be stabilized, and it is therefore possible to realize an accurate color display in a combination of three primary colors.

It is also preferable that each group is made up of two adjacent data signal lines. With this structure, when displaying in a combination of three primary colors, it is possible to display in an accurate color without the problem of generating significant color deviation caused by up-throw potential fluctuations and down-throw potential fluctuations of the data signal lines associated with the conventional structure where data signal lines corresponding to three primary colors do not belong in the same group.

It is also preferable that the data signal lines in each group are charged to the predetermined potential in a period between i) after a data signal supply period directly before a predetermined data signal supply period of the group and ii) before a first data signal starts being supplied in the predetermined data signal supply period of the group. With this structure, when supplying the data signal to the data signal line in the predetermined data signal supply period, the data signal is supplied to the data signal lines in the state where each data signal line is charged in advance to the predetermined potential. It is therefore possible to stabilize the potential of each data signal line.

A display device in accordance with another embodiment of the present invention is arranged so as to include a plurality of pixels, provided respectively at intersections of the plurality of data signal lines and the plurality of scanning signal lines; a plurality of data signal lines divided into a plurality of groups, each group being made up of sequentially provided data signal lines, and a plurality of switches provided respectively for the plurality of data signal lines in the group on an upstream side in a direction of supplying a data signal wherein respective ends of the plurality of switches of the group of data signal lines, on the upstream side in the direction of supplying of supplying the data signal are mutually connected, wherein the data signal lines are connected to a potential line which outputs a predetermined potential, via an auxiliary switch different from the above plurality of switches.

According to the foregoing structure, the data signal line is connected to the potential line which outputs the predetermined potential via the auxiliary switch different from the plurality of switches. It is therefore possible to charge all the data signal lines in the group to a predetermined potential before a data signal supply period for supplying a data signal by time-division. By setting the predetermined potential to the potential close to the potential to be applied to the data signal line in the data signal supply period, potential fluctuations to be applied to each data signal line due to the supply of a data signal in the data signal supply period can be made smaller as compared to the potential fluctuations from the potential of the data signal lines directly before supplying a data signal in the case where the data signal lines are not charged to the predetermined potential. As a result, it is possible to avoid a problem associated with the supply of a data signal to data signal lines in each group, i.e., potentials of the data signal lines to which a data signal has been supplied vary to a large degree due to electrostatic coupling of the data signal lines. Furthermore, by charging data signal lines in all the groups to a predetermined potential at the same time, it is possible to suppress the effects from the data signal lines in the adjacent group.

With the foregoing structure, it is possible to realize a display device wherein data signal lines are driven by time-division based on a group of sequentially provided data signal lines, which permit up-throw potential fluctuations and down-throw potential fluctuations when display to be suppressed.

It is preferable that the auxiliary switch in each group of data signal lines conducts in a period between i) after a data signal supply period directly before a predetermined data signal supply period of the group and ii) before a first data signal starts being supplied in the predetermined data signal supply period of the group. With this structure, when supplying the data signal to the data signal line in the predetermined data signal supply period, the data signal is supplied to the data signal lines in the state where each data signal is charged to a predetermined potential. It is therefore possible to stabilize the potential of the data signal line.

For any of the foregoing display devices, it is preferable that the polarity of a data signal to be supplied to the data signal line is reversed in each horizontal period. With this structure, in the case where large potential fluctuations of the data signal line are needed for each horizontal line, it is possible to stabilize the potential of each data signal line.

For any of the foregoing display devices, it is also preferable that the predetermined potential is an AC potential which can take at least two potential values. As a result, in the case where the potential of the data signal is selected from a plurality of potential ranges, it is possible to stabilize the potential of the data signal lines corresponding to each potential range.

It is also preferable that the predetermined potential be substantially an average value between a maximum potential value and a minimum potential value of a data signal to be supplied to the data signal line. With this structure, it is very likely that the difference between the potential of the data signal and the predetermined potential can be made small, and it is therefore possible to more stabilize the potential of the data signal line.

For any of the foregoing display devices, it is preferable be arranged be that a data signal to be supplied to the data signal line is subjected to be polarity inversion; and the predetermined potential is set substantially an average potential value between a maximum positive-polarity potential value and a minimum positive-polarity potential value of the data signal and substantially an average potential value between a maximum negative-polarity potential value and a minimum negative-polarity potential value of the data signal. According to the foregoing structure, both when supplying the positive polarity data signal and the negative-polarity, the effect of reducing the difference between the potential of the data signal and the predetermined potential is very likely to be achieved, thereby more stabilizing the potential of the data signal line.

For any of the foregoing display devices, it is preferable be arranged such that a voltage to be applied to an element provided in each pixel by a charged voltage of the data signal line is a potential difference between the predetermined potential and a reference potential, and the predetermined potential is therefore to be set up a potential that maximizes the voltage to be applied to the element, which is a potential most apart from the reference potential in an acceptable range of potential to be applied to the data signal line in each data signal supply period. As a result, up-throw potential fluctuations and down-throw potential fluctuations when display can be made small in contrast to the conventional structure which present large up-throw potential fluctuations and down-throw potential fluctuations when display, thereby realizing desirable display quality without a problem of tint difference in each color.

The method of driving the display device in accordance with the present embodiment, which is arranged such that a plurality of pixels are provided respectively at intersections of a plurality of data signal lines and a plurality of scanning signal lines; and a plurality of data signal lines divided into a plurality of groups, each group being made up of sequentially provided data signal lines, data signal lines in each group are driven by time-division via a common wiring provided on an upstream side in a direction of supplying a data signal, is arranged so as to charge data signal lines in each group of data signal lines to a predetermined potential in a period other than a data signal supply period of the group.

With this structure, the data signal lines of each group can be charged to the predetermined potential in a period other than the data signal supply period of the group. Therefore, it is possible to charge all the data signal lines of the group to the predetermined potential before a data signal supply period for supplying a data signal by time-division. By setting the predetermined potential to the potential close to the potential to be applied to the data signal line in the data signal supply period, the potential fluctuations to be applied to each data signal line due to the supply of a data signal in the data signal supply period can be made smaller as compared to the potential fluctuations from the potential of the data signal lines directly before supplying a data signal in the case where the data signal lines are not charged to the predetermined potential. As a result, it is possible to avoid a problem associated with the supply of a data signal to data signal lines in each group, i.e., potentials of the data signal lines to which a data signal has been supplied vary to a large degree due to electrostatic coupling of the data signal lines. Furthermore, by charging data signal lines in all the groups to a predetermined potential at the same time, it is possible to suppress the effects from the data signal lines in the adjacent group.

With the foregoing structure, it is possible to realize a method of driving a display device wherein data signal lines are driven by time-division based on a group of sequentially provided data signal lines, which permit up-throw potential fluctuations and down-throw potential fluctuations when display to be suppressed.

Incidentally, it is preferable that each group is made up of three data signal lines respectively corresponding to three primary colors which constitute a display color. With this structure, potentials of the data signals for three primary colors can be stabilized, and it is therefore possible to realize an accurate color display in a combination of three primary colors.

It is also preferable that each group is made up of two adjacent data signal line. With this structure, when displaying in a combination of three primary colors, it is possible to display in an accurate color without the problem of generating significant color deviation caused by up-throw potential fluctuations and down-throw potential fluctuations of the data signal lines associated with the conventional structure where data signal lines corresponding to three primary colors do not belong in the same group.

For any of the driving methods, it is also preferable that the data signal lines in each group are charged to the predetermined potential in a period between i) after a data signal supply period directly before a predetermined data signal supply period of the group and ii) before a first data signal starts being supplied in the predetermined data signal supply period of the group. With this structure, when supplying the data signal to the data signal line in the predetermined data signal supply period, the data signal is supplied to the data signal lines in the state where each data signal is charged to a predetermined potential. It is therefore possible to stabilize the potential of the data signal line.

For any of the foregoing display devices, it is preferable that the polarity of a data signal to be supplied to the data signal line is inversed in each horizontal period. With this structure, in the case where it is necessary to have large potential fluctuations, the potential of the data signal line for each horizontal line, it is possible to stabilize the potential of the data signal line.

For any of the foregoing display devices, it is preferable that the predetermined potential is an AC potential which can take at least two potential values. As a result, in the case where the potential of the data signal is selected from a plurality of potential ranges, it is possible to stabilize the potential of the data signal lines corresponding to each potential range.

It is also preferable that the predetermined potential be substantially an average value between a maximum potential value and a minimum potential value of a data signal to be supplied to the data signal line. With this structure, the effect of reducing the difference between the potential of the data signal and the predetermined potential is very likely to be achieved, thereby more stabilizing the potential of the data signal line.

For any of the foregoing driving methods, it is preferable that a data signal to be supplied to the data signal line is subjected to a polarity inversion; and the predetermined potential is substantially an average potential value between a maximum positive-polarity potential value and a minimum positive-polarity potential value of the data signal, and substantially an average potential value between a maximum negative-polarity potential value and a minimum negative-polarity potential value of the data signal. With this structure, when supplying a positive-polarity data signal and when supplying a negative-polarity data signal, it is very likely that a difference between the potential of the data signal and the reference potential be small, thereby more desirably stabilizing the potential of the data signal line.

For any of the foregoing driving methods, it is preferable be arranged such that a voltage to be applied to an element provided in each pixel by a charged voltage of the data signal line is a voltage to be applied to an element provided in each pixel by a charged voltage of the data signal line is a potential difference between the predetermined potential and a reference potential, and the predetermined potential is therefore to be set up a potential that maximizes the voltage to be applied to the element, which is a potential most apart from the reference potential in an acceptable range of potential to be applied to the data signal line in each data signal supply period. According to the foregoing structure, up-throw potential fluctuations and down-throw potential fluctuations when display can be suppressed in contrast to the conventional structure which present large up-throw potential fluctuations and down-throw potential fluctuations when display, thereby realizing desirable display quality without a problem of tint difference in each color.

As described, the display device and the driving method of a display device in accordance with the embodiments of the present invention are applicable to display devices which display by charging capacitive pixels via data signal lines.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display device comprising:

a plurality of data signal lines divided into a plurality of groups, each group being made up of sequentially provided data signal lines;

a plurality of scanning signal lines;

a data output circuit for outputting data signals to the plurality of data signal lines;

a plurality of pixels, provided respectively at intersections of said plurality of data signal lines and said plurality of scanning signal lines; and a plurality of switches provided for each group of data signal lines, wherein respective data output sides of said plurality of switches are connected to respective ends on one side of said plurality of data signal lines, and respective data input sides of said plurality of switches are mutually connected to the data output circuit, and said plurality of switches output the data signals to each group of data signal lines by time-division in each horizontal scanning period and turn ON respective groups of data signal lines at the same time to simultaneously output the data signals, wherein a polarity of each of the data signals is inverted for each frame, and the data output circuit charges the data signal lines in each group to a predetermined potential only in a vertical blank period, and the switches are conducted also in a period in which the data output circuit charges the data signal lines.

2. The display device as set forth in claim 1, wherein:

each group of said plurality of groups is made up of three data signal lines respectively corresponding to three primary colors which constitute a display color.

3. The display device as set forth in claim 1, wherein:

each group of said plurality of groups is made up of two adjacent data signal lines.

4. The display device as set forth in claim 1, wherein:

said predetermined potential is an AC potential which can take at least two potential values.

5. The display device as set forth in claim 1, wherein:

said predetermined potential is substantially an average value between a maximum potential value and a minimum potential value of a data signal to be supplied to the data signal line.

6. The display device as set forth in claim 1, wherein:

a data signal to be supplied to the data signal line is subjected to a polarity inversion; and said predetermined potential is substantially an average potential value between a maximum positive-polarity potential value and a minimum positive-polarity potential value of the data signal, and substantially an average potential value between a maximum negative-polarity potential value and a minimum negative-polarity potential value of the data signal.

7. The display device as set forth in claim 1, wherein:

a voltage to be applied to an element provided in each pixel by a charged voltage of the data signal line is a potential difference between the predetermined potential and a reference potential, and the predetermined potential is set as a potential that maximizes the voltage to be applied to the element, and is apart from the reference potential in a predetermined range of potential to be applied to said data signal line in each data signal supply period.

8. A display device comprising:

a plurality of data signal lines divided into a plurality of groups, each group being made up of sequentially provided data signal lines;

a plurality of scanning signal lines;

a plurality of pixels, provided respectively at intersections of said plurality of data signal lines and said plurality of scanning signal lines;

a plurality of switches, provided for each group of data signal lines, whose respective data output sides are connected to respective ends on one side of said plurality of data signal lines, and whose respective data input sides are mutually connected, wherein said plurality of switches output data signals to each group of data signal lines by time-division in each horizontal scanning period and turn ON respective groups of data signal lines at the same time to simultaneously output data signals;

a potential line to which a predetermined potential is to be applied; and an auxiliary switch for connecting each data signal line to said potential line only in a vertical blank period, wherein a polarity of each of the data signals is inverted for each frame.

9. The display device as set forth in claim 8, wherein:

said predetermined potential is an AC potential which can take at least two potential values.

10. The display device as set forth in claim 8, wherein:

said predetermined potential is substantially an average value between a maximum potential value and a minimum potential value of a data signal to be supplied to the data signal line.

11. The display device as set forth in claim 8, wherein:

a data signal to be supplied to the data signal line is subjected to a polarity inversion; and said predetermined potential is substantially an average potential value between a maximum positive-polarity potential value and a minimum positive-polarity potential value of the data signal, and substantially an average potential value between a maximum negative-polarity potential value and a minimum negative-polarity potential value of the data signal.

12. The display device as set forth in claim 8, wherein:

a voltage to be applied to an element provided in each pixel by a charged voltage of the data signal line is a potential difference between the predetermined potential and a reference potential, and the predetermined potential is to be set up a potential that maximizes the voltage to be applied to the element, which is a potential most apart from the reference potential in a predetermined range of potential to be applied to said data signal line in each data signal supply period.

13. A method of driving a display device, which comprises a plurality of data signal lines divided into a plurality of groups, each group being made up of sequentially provided data signal lines, a data output circuit for outputting data signals to the plurality of data signal lines; and a plurality of pixels, provided respectively at intersections of said plurality of data signal lines and a plurality of scanning signal lines, data signal lines in each group are driven by time-division via a common wiring provided on a data signal supply side, said method comprising:

a first step for outputting a data signal to data signal lines in each group in a data signal supply period of the group, and a plurality of switches output data signals to each group of data signal lines by time-division in each horizontal scanning period and turn ON respective groups of data signal lines at the same time to simultaneously output the data signals, wherein a polarity of each of the data signals is inverted for each frame; and a second step for charging data signal lines in the group to a predetermined potential only in a vertical blank period, and the switches are conducted also in a period in which the data output circuit charges the data signal lines.

14. The method of driving a display device as set forth in claim 13, wherein:

each group of said plurality of groups is made up of three data signal lines respectively corresponding to three primary colors which constitute a display color.

15. The method of driving a display device as set forth in claim 13, wherein:

each group of said plurality of groups is made up of two adjacent data signal lines.

16. The method of driving a display device as set forth in claim 13, wherein:

said predetermined potential is an AC potential which can take at least two potential values.

17. The method of driving a display device as set forth in claim 13, wherein:

said predetermined potential is substantially an average value between a maximum potential value and a minimum potential value of a data signal to be supplied to the data signal line.

18. The method of driving a display device as set forth in claim 13, wherein:

a data signal to be supplied to the data signal line is subjected to a polarity inversion; and said predetermined potential is substantially an average potential value between a maximum positive-polarity potential value and a minimum positive-polarity potential value of the data signal, and substantially an average potential value between a maximum negative-polarity potential value and a minimum negative-polarity potential value of the data signal.

19. The method of driving a display device as set forth in claim 13, wherein:

a voltage to be applied to an element provided in each pixel by a charged voltage of the data signal line is a potential difference between the predetermined potential and a reference potential, and the predetermined potential is to be set up a potential that maximizes the voltage to be applied to the element, which is a potential most apart from the reference potential in a predetermined range of potential to be applied to said data signal line in each data signal supply period.

* * * * *